US008154541B2

(12) United States Patent
Koyama et al.

(10) Patent No.: US 8,154,541 B2
(45) Date of Patent: Apr. 10, 2012

(54) DISPLAY DEVICE, DRIVING METHOD THEREOF AND ELECTRONIC APPLIANCE

(75) Inventors: Jun Koyama, Kanagawa (JP); Shunpei Yamazaki, Tokyo (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1131 days.

(21) Appl. No.: 11/572,158

(22) PCT Filed: Jul. 28, 2005

(86) PCT No.: PCT/JP2005/014256

§ 371 (c)(1),
(2), (4) Date: Jan. 16, 2007

(87) PCT Pub. No.: WO2006/011666

PCT Pub. Date: Feb. 2, 2006

(65) Prior Publication Data

US 2008/0094009 A1 Apr. 24, 2008

(30) Foreign Application Priority Data

Jul. 30, 2004 (JP) ..... 2004-224309

(51) Int. Cl.
*G09G 3/30* (2006.01)
*G09G 3/32* (2006.01)

(52) U.S. Cl. ..... 345/211; 345/76; 345/82

(58) Field of Classification Search ..... 345/76–83, 345/207, 211–214, 690; 315/169.1–169.4
See application file for complete search history.

(56) References Cited

U.S. PATENT DOCUMENTS 6,329,758 B1 * 12/2001 Salam ..... 315/169.2
6,528,951 B2 3/2003 Yamazaki et al.
6,828,950 B2 12/2004 Koyama
7,006,026 B2 2/2006 Jo
7,023,141 B2 4/2006 Anzai et al.
(Continued)

FOREIGN PATENT DOCUMENTS

EP 1 148 466 A2 10/2001
(Continued)

OTHER PUBLICATIONS

Japan 2002-123219—English abstract provided by esp@cenet Worldwide (2006) and family to U.S. Patent Application Publication No. 2002/0017643, U.S. Patent Application Publication No. 2005/0017933 and U.S. Patent No. 6,828,950.

(Continued)

*Primary Examiner* — Kevin M Nguyen
(74) *Attorney, Agent, or Firm* — Fish & Richardson P.C.

(57) ABSTRACT

A display device is provided where fluctuation of current values of a light-emitting element caused by the ambient temperature change and degradation with time is suppressed. According to the invention, a monitoring element driven with a constant current is provided. After detecting a voltage in the monitoring element, the voltage is applied to a light-emitting element. That is, the monitoring element is driven with a constant current, and a voltage in the monitoring element is applied to the light-emitting element so that the light-emitting is driven with a constant voltage. When a predetermined condition is satisfied, an extrapolation power supply circuit samples voltages of the monitoring element, obtaining a mathematical formula of a change of the sampled voltages and generating a voltage based on the mathematical formula, which is supplied to the light-emitting element.

14 Claims, 21 Drawing Sheets

U.S. PATENT DOCUMENTS

| | | | | |
|---|---|---|---|---|
| 7,298,347 | B2 | 11/2007 | Yamazaki et al. | |
| 7,453,383 | B2 | 11/2008 | Jo | |
| 2001/0030511 | A1 | 10/2001 | Yamazaki et al. | |
| 2001/0033252 | A1 | 10/2001 | Yamazaki et al. | |
| 2002/0017643 | A1* | 2/2002 | Koyama | 257/59 |
| 2002/0125831 | A1* | 9/2002 | Inukai et al. | 315/169.3 |
| 2004/0150594 | A1 | 8/2004 | Koyama et al. | |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |
| 2005/0225250 | A1 | 10/2005 | Anzai et al. | |
| 2006/0022206 | A1 | 2/2006 | Hayakawa et al. | |
| 2006/0102919 | A1 | 5/2006 | Watanabe et al. | |
| 2006/0108936 | A1 | 5/2006 | Anzai et al. | |

FOREIGN PATENT DOCUMENTS

| | | | |
|---|---|---|---|
| EP | 1168291 | A2 | 1/2002 |
| JP | 2002072964 | A | 3/2002 |
| JP | 2002-123219 | | 4/2002 |
| JP | 2002-333861 | | 11/2002 |
| JP | 2003029710 | A | 1/2003 |
| JP | 2003-202838 | | 7/2003 |
| JP | 2003-263132 | | 9/2003 |
| JP | 2003-323159 | | 11/2003 |
| JP | 2004070349 | A | 3/2004 |
| JP | 2004205704 | A | 7/2004 |
| JP | 2005045771 | A | 2/2005 |
| JP | 2006011388 | A | 1/2006 |
| JP | 2006154789 | A | 6/2006 |

OTHER PUBLICATIONS

Japan 2002-333861—English abstract provided by esp@cenet Worldwide (2006) and family to U.S. Patent Application Publication No. 2001/0033252, U.S. Patent Application Publication No. 2001/0030511, U.S. Patent Application Publication No. 2005/0012731, U.S. Patent Application Publication No. 2005/0017963 and U.S. Patent Application Publication No. 2005/0017964.

Japan 2003-202838—English abstract provided by esp@cenet Worldwide (2006).

Japan 2003-263132—English abstract provided by esp@cenet Worldwide (2006).

Japan 2003-323159—English abstract provided by esp@cenet Worldwide (2006) and family to U.S. Patent Application Publication No. 2005/0225250, U.S. Patent Application Publication No. 2006/0108936 and U.S. Patent No. 7,023,141.

International Search Report (Application No. PCT/JP2005/014256) mailed Nov. 1, 2005.

Written Opinion (Application No. PCT/JP2005/014256) mailed Nov. 1, 2005.

* cited by examiner

DISPLAY DEVICE, DRIVING METHOD THEREOF AND ELECTRONIC APPLIANCE

TECHNICAL FIELD

The present invention relates to a semiconductor device provided with a function to control a current supplied to a load with a transistor. In particular, the invention relates to a semiconductor device having pixels each including a current-drive type light-emitting element, the luminance of which changes with a current, and a signal line driver circuit thereof. In addition, the invention relates to an electronic appliance.

BACKGROUND ART

In recent years, a so-called self-luminous display device is attracting attention, which has pixels each including a light-emitting element such as a light-emitting diode (LED). As the light-emitting element used for such a self-luminous display device, an organic light-emitting diode (also referred to as an OLED, an organic EL element, an electroluminescence: EL element and the like) is attracting attention, and is becoming to be used for an organic EL display.

The light-emitting element such as an OLED is a self-luminous type; therefore, it has such advantages that the visibility of pixels is high, no back light is required and high response rate is attained as compared to a liquid crystal display. In addition, the luminance of the light-emitting element is controlled by a current value flowing thereto. Therefore, in order to display gray scales accurately, there has been proposed a display device using a constant current drive where a constant current is supplied to the light-emitting element (see Patent Document 1).

[Patent Document 1] Japanese Patent Laid-Open No. 2003-323159

DISCLOSURE OF INVENTION

A light-emitting layer in a light-emitting element has a property that the resistance value (internal resistance value) thereof changes according to the ambient temperature. Specifically, assuming that the room temperature is a normal temperature, when the ambient temperature becomes higher than the normal temperature, the resistance value decreases, and when the ambient temperature becomes lower than the normal temperature, on the other hand, the resistance value increases. Therefore, even if a constant voltage drive is performed to apply a constant voltage to the light-emitting element, the current value increases as the ambient temperature becomes higher, which leads to a higher luminance than the desired luminance. Meanwhile, as the ambient temperature becomes lower, the current value decreases, which leads to a lower luminance than the desired luminance. In addition, the light-emitting element has a property that the current value thereof decreases with time. That is, as compared to an initial state where a current starts to be supplied to the light-emitting element, the resistance value of the light-emitting element becomes higher after a certain period of time has passed. Accordingly, the current value flowing to the light-emitting element decreases with time even if a constant voltage is applied to the light-emitting element.

When the ambient temperature changes or degradation is caused with time due to the properties of the light-emitting element as set forth above, luminance thereof varies. In view of the foregoing circumstances, it is a primary object of the invention to provide a display device where an effect of fluctuation of current values of a light-emitting element, which is caused by the ambient temperature change and degradation with time, is suppressed.

A display device of the invention includes a monitoring element, a current source for supplying a current to the monitoring element, an amplifier, and a light-emitting element. A voltage of the monitoring element is detected by the amplifier, and substantially the same voltage is applied to the light-emitting element.

A display device of the invention includes a monitoring element, a current source for supplying a current to the monitoring element, an amplifier, and a light-emitting element. One electrode of the monitoring element and one electrode of the light-emitting element are connected to a power supply at a fixed potential, and the other electrode of the light-emitting element is set at the same potential as the other electrode of the monitoring element by the amplifier.

The display device of the invention having the aforementioned structure further includes an extrapolation power supply circuit for sampling voltages generated in the monitoring element, obtaining a mathematical formula of a change of the sampled voltages, and generating a voltage based on the mathematical formula. When a preset condition is satisfied, the voltage generated by the extrapolation power supply circuit is applied to the light-emitting element.

A display device of the invention includes a monitoring element, a current source for supplying a current to the monitoring element, an amplifier for outputting the same or substantially the same voltage as a voltage generated in the monitoring element, an extrapolation power supply circuit for sampling voltages generated in the monitoring element, obtaining a mathematical formula of the sampled voltages and generating a voltage based on the mathematical formula, a light-emitting element, and a selection switch for selecting one of the output of the amplifier and the output of the extrapolation power supply circuit as a voltage source for supplying a voltage to the light-emitting element.

A display device of the invention includes a monitoring element, a current source for supplying a current to the monitoring element, an extrapolation power supply circuit for sampling voltages generated in the monitoring element, obtaining a mathematical formula of a change of the sampled voltages and generating a voltage based on the mathematical formula, a light-emitting element, an amplifier for outputting the same or substantially the same voltage as an inputted voltage, and a selection switch for selecting one of the voltage generated in the monitoring element and the voltage generated by the extrapolation power supply circuit as a voltage inputted to the amplifier.

In the display of the invention having the aforementioned structure, the monitoring element is provided in plural number and connected to each other in parallel.

In the display of the invention having the aforementioned structure, the monitoring element is provided correspondingly to each emission color of the light-emitting element, and the light emitting layer of the monitoring element and the light emitting layer of the light-emitting element are formed of the same material.

In the display of the invention having the aforementioned structure, the amplifier is a voltage follower circuit.

In the display of the invention having the aforementioned structure, selection of the selection switch is switched after a preset emission period of the monitoring element has passed.

An electronic appliance of the invention includes as a display portion the display device having the aforementioned structure.

An active matrix display device of the invention includes a monitoring element, a current source for supplying a current to the monitoring element, an amplifier for outputting the same or substantially the same potential as an anode of the monitoring element, an extrapolation power supply circuit for sampling potentials of the anode of the monitoring element, obtaining a mathematical formula of a change of the sampled potentials and generating a potential based on the mathematical formula, a light-emitting element, a transistor for controlling the drive of the light-emitting element, and a switch for controlling a source terminal or a drain terminal of the transistor to be connected to one of an output terminal of the amplifier and an output terminal of the extrapolation power supply circuit.

An active matrix display device of the invention includes a monitoring element, a current source for supplying a current to the monitoring element, an extrapolation power supply circuit for sampling potentials of an anode of the monitoring element, obtaining a mathematical formula of a change of the sampled potentials and generating a potential based on the mathematical formula, an amplifier for outputting the same or substantially the same voltage as an inputted voltage, a switch for controlling the connection of an input terminal of the amplifier to one of the anode of the monitoring element and an output terminal of the extrapolation power supply circuit, a light-emitting element, and a transistor for controlling the drive of the light-emitting element, in which an output terminal of the amplifier is connected to a source terminal or a drain terminal of the transistor.

In the active matrix display device of the invention having the aforementioned structure, the monitoring element is provided in plural number and connected in parallel.

In the active matrix display device of the invention having the aforementioned structure, a cathode of the monitoring element and a cathode of the light-emitting element are connected.

A passive matrix display device of the invention includes a pixel portion which has a plurality of light-emitting elements and a matrix arrangement of column signal lines and row signal lines, a monitoring element, a current source for supplying a current to the monitoring element, an amplifier for outputting the same or substantially the same potential as an anode of the monitoring element, an extrapolation power supply circuit for sampling potentials of the anode of the monitoring element, obtaining a mathematical formula of a change of the sampled potentials and generating a potential based on the mathematical formula, and a switch for controlling the column signal line to be connected to an output terminal of the amplifier or an output terminal of the extrapolation power supply circuit.

A passive matrix display device of the invention includes a pixel portion which has a plurality of light-emitting elements and a matrix arrangement of column signal lines and row signal lines, a monitoring element, a current source for supplying a current to the monitoring element, an extrapolation power supply circuit for sampling potentials of an anode of the monitoring element, obtaining a mathematical formula of a change of the sampled potentials and generating a potential based on the mathematical formula, an amplifier, and a switch for controlling an input terminal of the amplifier to be connected to the anode of the monitoring element or an output terminal of the extrapolation power supply circuit, in which a potential of the column signal line is inputted by the amplifier.

In the passive matrix display device of the invention having the aforementioned structure, the monitoring element is provided in plural number and connected in parallel.

In the passive matrix display device of the invention having the aforementioned structure, the monitoring element is connected to the row signal line.

A driving method of a display device of the invention which includes a monitoring element, a current source, an extrapolation power supply circuit, an amplifier and a light-emitting element, includes the steps of: supplying a current to the monitoring element from the current source; sampling voltages of the monitoring element, obtaining a mathematical formula of a change of the sampled voltages and generating a voltage based on the mathematical formula by the extrapolation power supply circuit; impedance-converting the voltage generated in the monitoring element by the amplifier; applying a voltage outputted from the amplifier to the light-emitting element until a preset condition is satisfied; and applying a voltage outputted from the extrapolation power supply circuit to the light-emitting element, that is, switching a voltage supply source of the light-emitting element when the preset condition is satisfied.

A driving method of a display device of the invention which includes a monitoring element, a current source, an extrapolation power supply circuit, an amplifier and a light-emitting element, includes the steps of: supplying a current to the monitoring element from the current source; sampling voltages of the monitoring element, obtaining a mathematical formula of a change of the sampled voltages and generating a voltage based on the mathematical formula by the extrapolation power supply circuit; impedance-converting the voltage generated in the monitoring element or the voltage generated in the extrapolation power supply circuit by the amplifier; keeping an input terminal of the amplifier connected to an anode of the monitoring element until a preset condition is satisfied; and connecting the input terminal of the amplifier to an output terminal of the extrapolation power supply circuit, that is, switching a voltage supply source of the light-emitting element when the preset condition is satisfied.

Luminance variations of a light-emitting element resulting from the ambient temperature change can be decreased, and a display device having such a light-emitting element in which degradation of apparent luminance is suppressed, can be provided.

BEST MODE FOR CARRYING OUT THE INVENTION

Although the invention will be fully described by way of embodiment modes and embodiments with reference to the accompanying drawings, it is to be understood that various changes and modifications will be apparent to those skilled in the art. Therefore, unless otherwise such changes and modifications depart from the scope of the invention, they should be construed as being included therein.

Embodiment Mode 1

Description is made below with reference to FIG. 1 on the basic principle of a temperature/degradation compensation circuit (hereinafter simply referred to as a compensation circuit) included in the display device of the invention.

A basic current source 101 supplies a constant current to a monitoring element 102. That is, the monitoring element 102 is driven with a constant current. Accordingly, the current value of the monitoring element 102 is constant at all times. When the ambient temperature changes under such conditions, the resistance value of the monitoring element 102 per se changes. When the resistance value of the monitoring element 102 changes, the potential difference between opposite electrodes of the monitoring element 102 changes since the current value thereof is constant. By detecting the potential difference between the opposite electrodes of the monitoring element 102, changes in the ambient temperature are detected. Specifically, a potential of an electrode of the monitoring element 102, which is fixed at a constant potential, namely a potential of a cathode in FIG. 1 does not change. Therefore, a potential change of the other electrode of the monitoring element 102 which is connected to the current source 101, namely a potential of an anode 103 in FIG. 1 is detected.

Figure 11:
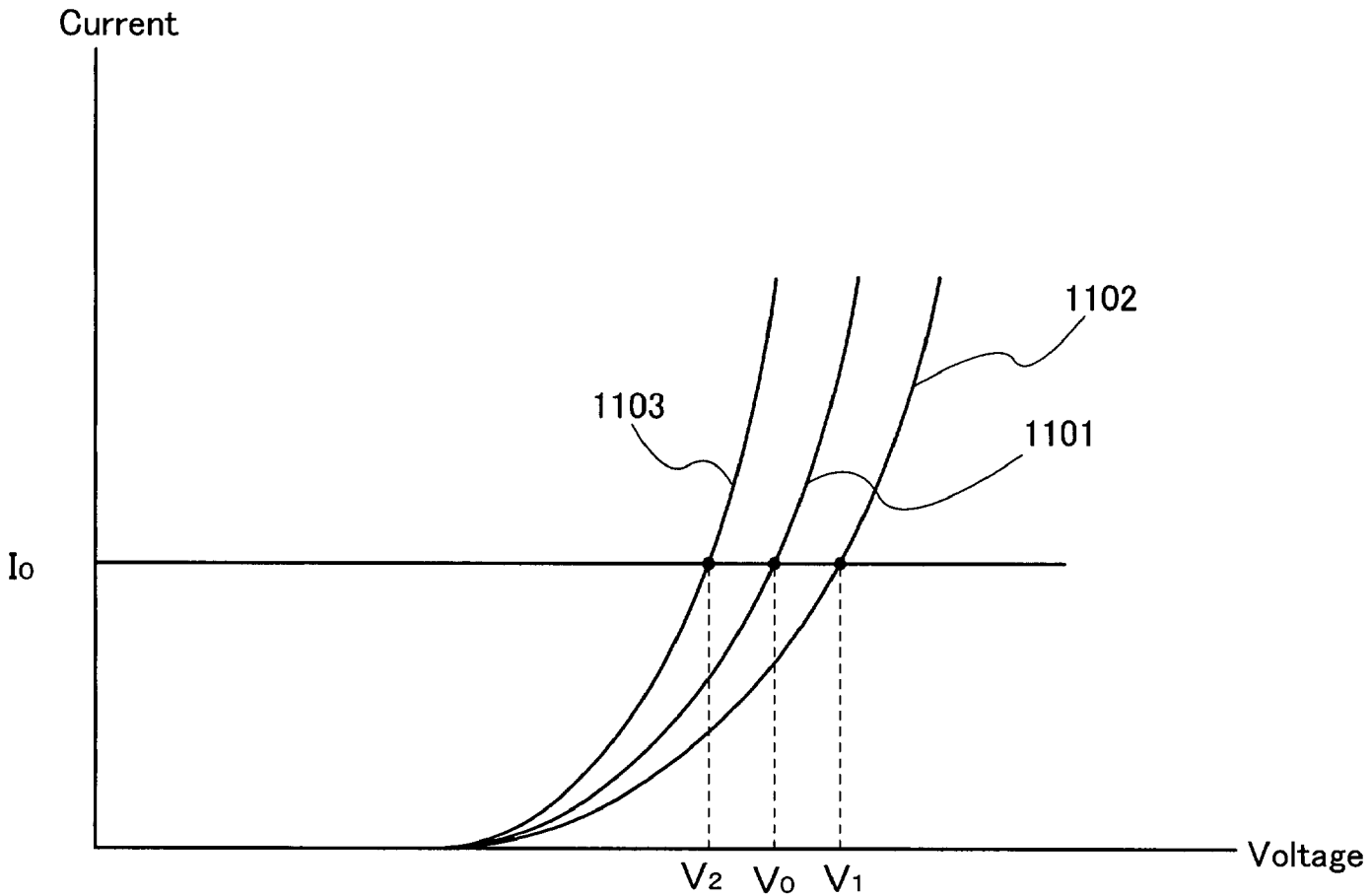
FIG. 11 illustrates the temperature dependence of the V-I characteristics of a monitoring element.

Here, description is made with reference to FIG. 11 on the temperature dependence of the V-I characteristics of the monitoring element 102. The V-I characteristics of the monitoring element 102 at a room temperature (e.g., 25° C.), a low temperature (e.g., −20° C.) and a high temperature (e.g., 70° C.) are shown by lines 1101, 1102 and 1103 respectively. Provided that a current value which flows from the current source 101 to the monitoring element 102 is $I_0$, a voltage of $V_0$ is generated in the monitoring element 102 at the room temperature. Meanwhile, a voltage of $V_1$ is generated at the low temperature and a voltage of $V_2$ is generated at the high temperature. That is, when a current lo flows to the monitoring element 102 at the room temperature, a voltage drops to $V_0$; the monitoring element 102 at the low temperature, $V_1$; and the monitoring element 102 at the high temperature, $V_2$. Accordingly, the temperature can be compensated by applying a voltage of $V_1$ to the light-emitting element 115 when the ambient temperature becomes low while applying a voltage of $V_2$ to the light-emitting element 115 when the ambient temperature becomes high.

Figure 12:
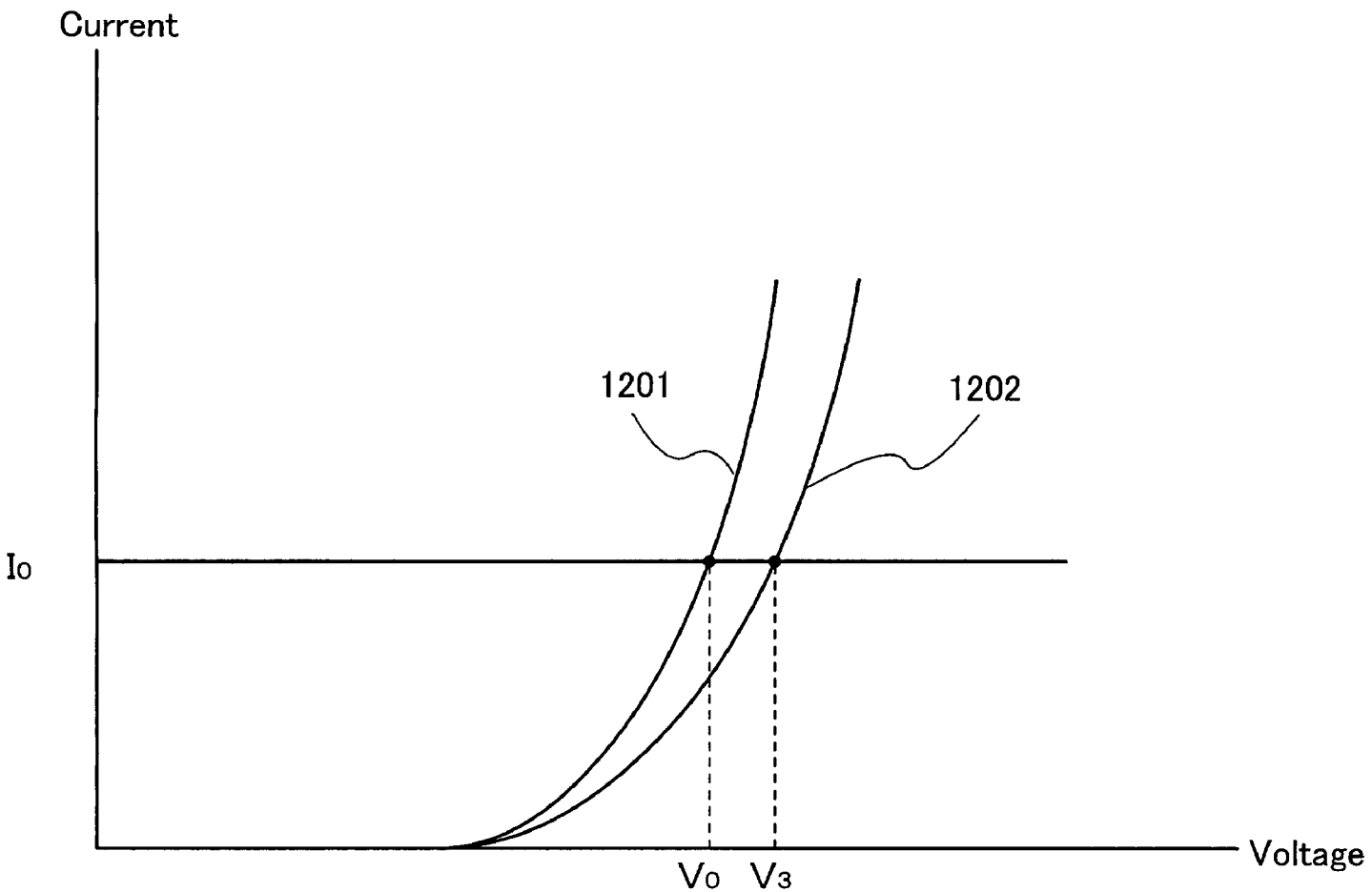
FIG. 12 illustrates changes with time of the V-I characteristics of a monitoring element due to the degradation thereof.

FIG. 12 illustrates changes with time of the V-I characteristics of the monitoring element 102. Initial characteristics of the monitoring element 102 are shown by a line 1201 while characteristics of the monitoring element 102 which has degraded are shown by a line 1202. Note that it is assumed here that the initial characteristics and the characteristics after having degraded are measured under the same temperature condition (room temperature). When a current $I_0$ flows to the monitoring element 102 under the condition of the initial characteristics, a voltage of $V_0$ is generated in the monitoring element 102 while a voltage of $V_3$ is generated in the monitoring element 102 which has degraded. Accordingly, an apparent degradation of the light-emitting element 115 can be decreased if the voltage of $V_3$ is applied to the light-emitting element 115 which has degraded similarly.

According to the invention, a voltage which is generated based on such data on the ambient temperature change and degradation with time is applied to the light-emitting element 115. That is, the voltage value is set in accordance with the changes in the resistance value of the light-emitting element 115 resulting from the ambient temperature change and degradation with time. In this manner, luminance variations of the light-emitting element 115 resulting from the ambient temperature change and degradation with time are suppressed. In addition, a specific condition is preset, and a voltage supply source is switched when the condition is satisfied. Thus, a stable voltage supply source can be provided.

Description is made below in further details. First, terminals a and c of a switch 106 are connected. At this time, a potential of the anode 103 of the monitoring element 102 is inputted to an amplifier 104, and impedance conversion is carried out. Then, the amplifier 104 outputs the same potential as the potential of the anode 103, which is then inputted to a source terminal of a driving transistor 114. Thus, when the driving transistor 114 is turned ON, a voltage generated in the monitoring element 102 is applied to the light-emitting element 115. Accordingly, by actually driving the display device with a constant voltage, a constant current drive of the light-emitting element 115 can be performed apparently. That is, fluctuation of current values resulting from the temperature change and degradation with time can be suppressed. Note that in FIG. 1, the cathodes of the monitoring element 102 and the light-emitting element 115 are connected to the ground potential GND; however, the invention is not limited to this as long as the potentials of the cathodes of the monitoring element 102 and the light-emitting element 115 are the same.

Meanwhile, analog data including the voltage generated in the monitoring element 102 at this time is converted to digital data in an A/D converter 107, and then inputted to a voltage-mathematization circuit 108. A temperature-characteristic-detection monitoring circuit 111 monitors the temperature, and inputs the detected temperature data to the voltage-mathematization circuit 108. In addition, data on the emission period of the monitoring element 102 which is counted by a counter circuit 113 is inputted to the voltage-mathematization circuit 108. Based on such data, the voltage-mathematization circuit 108 mathematizes a voltage according to each temperature condition. Then, the anathematized data is stored in a memory circuit 112.

The voltage-mathematization circuit 108 calculates a voltage to be applied to the light-emitting element 115 based on the data obtained by obtaining mathematical formula of the voltage change of the monitoring element 102 which is stored in the memory circuit 112, the temperature condition monitored by the temperature-characteristic-detection monitoring circuit 111, and the time condition inputted from the counter circuit 113. Digital data of the voltage obtained by such calculation is inputted to a D/A converter circuit 109. Then, it is converted to an analog voltage by the D/A converter circuit 109. Further, the data of the analog voltage is impedance-converted by an amplifier 110. In this manner, a potential obtained by compensating changes in the current value resulting from the temperature change and degradation with time is inputted to a terminal b of the switch 106 as well.

Next, the connection of the switch 106 is switched when a preset condition is satisfied. That is, the terminals a and c of the switch 106 are disconnected while the terminals b and c thereof are connected. In this manner, the voltage applied to the light-emitting element 115 is switched to the voltage generated by an extrapolation power supply circuit 105 from the voltage which is inputted after detecting a potential of the monitoring element 102 and impedance-converting the potential in the amplifier 104.

Figure 2A:
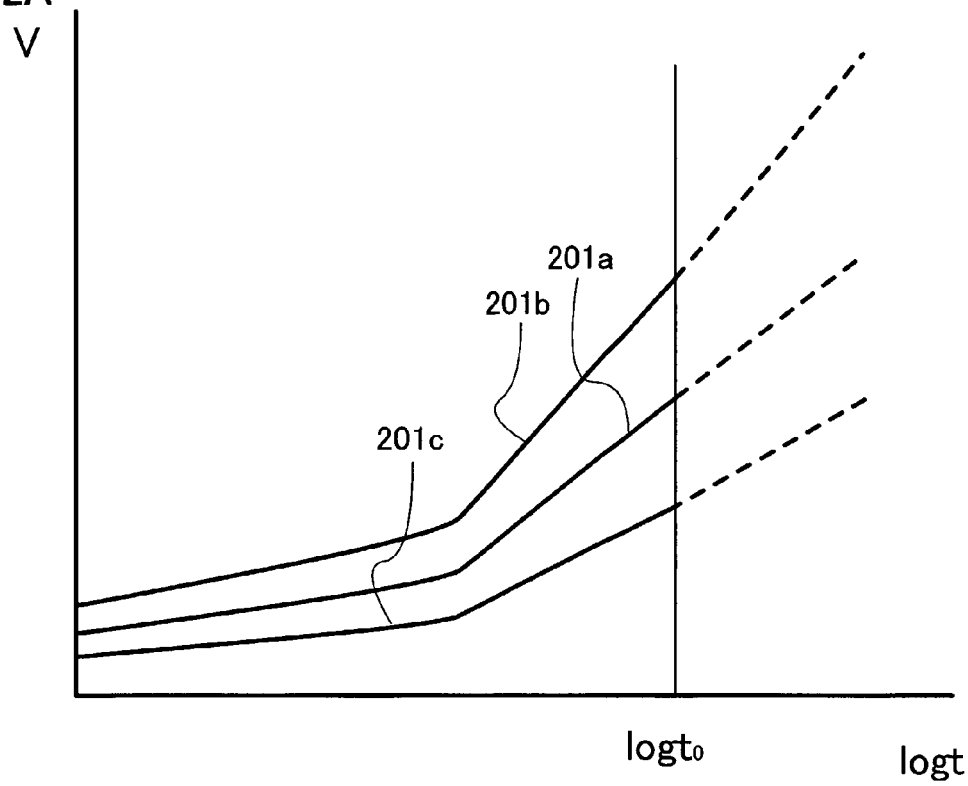
FIGS. 2A and 2B illustrate changes with time of a voltage applied to a light-emitting element.

FIG. 2A illustrates changes of a voltage generated in the light-emitting element 115. A line 201*a* shows the voltage change at a room temperature, a line 201*b* shows the voltage change at a low temperature, and a line 201*c* shows the voltage change at a high temperature. Solid lines until $logt_0$ denote the actual measurement values of a potential of the anode 103 of the monitoring element 102 while dotted lines after the $logt_0$ denote the anathematized values obtained by estimating the voltage of the monitoring element 102 which changes with time, based on the sampled potential change of the anode 103. That is, until the $logt_0$, the extrapolation power supply circuit 105 samples the potential change of the anode 103 of the monitoring element 102 to perform mathematization using an interpolation method or the like. In other words, a mathematical formula expressing a relation between accumulated emission period of the monitoring period 102 and voltage applied to the monitoring element 102 is obtained. After the $logt_0$, the extrapolation power supply circuit 105 generates a voltage obtained by the mathematical formula. In the case of FIG. 2A, the actual measurement data is measured until the $logt_0$, and the voltage change after that is mathematized by estimation. In addition, the actual measurement data is obtained and mathematized according to each temperature condition. That is, the voltage change of the anode 103 of the monitoring element 102 is mathematized by monitoring the temperature using the temperature-characteristic-detection monitoring circuit 111 according to each temperature condition.

Figure 2B:
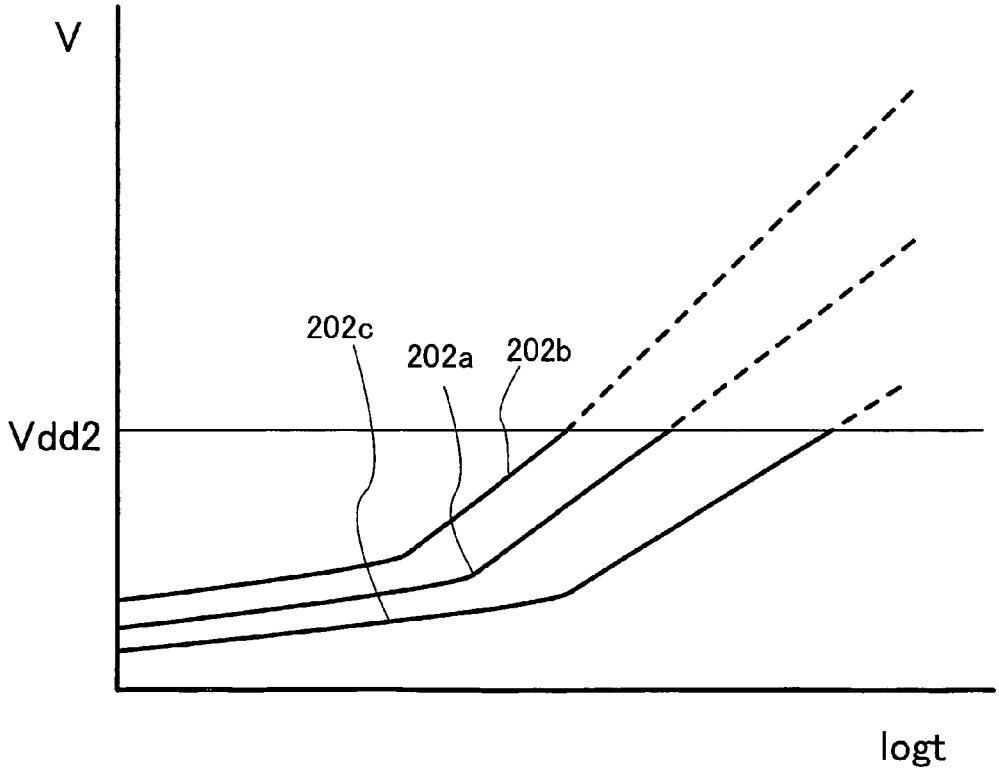

Alternatively, as shown in FIG. 2B, the voltage change may be mathematized by measuring data on the actual potential value of the anode 103 of the monitoring element 102 until rising up to a certain voltage VDD2. Note that a line 202*a* denotes the voltage change at a normal temperature, a line 202*b* denotes the voltage change at a low temperature, and a line 202*c* denotes the voltage change at a high temperature.

By switching a voltage supply source like the invention, a voltage can be supplied to the light-emitting element even when the monitoring element 102 is continuously used and thus breaks down. In addition, as a voltage can be supplied in accordance with the characteristic change of the light-emitting element for each temperature condition, the temperature and degradation can be compensated.

Figure 3:
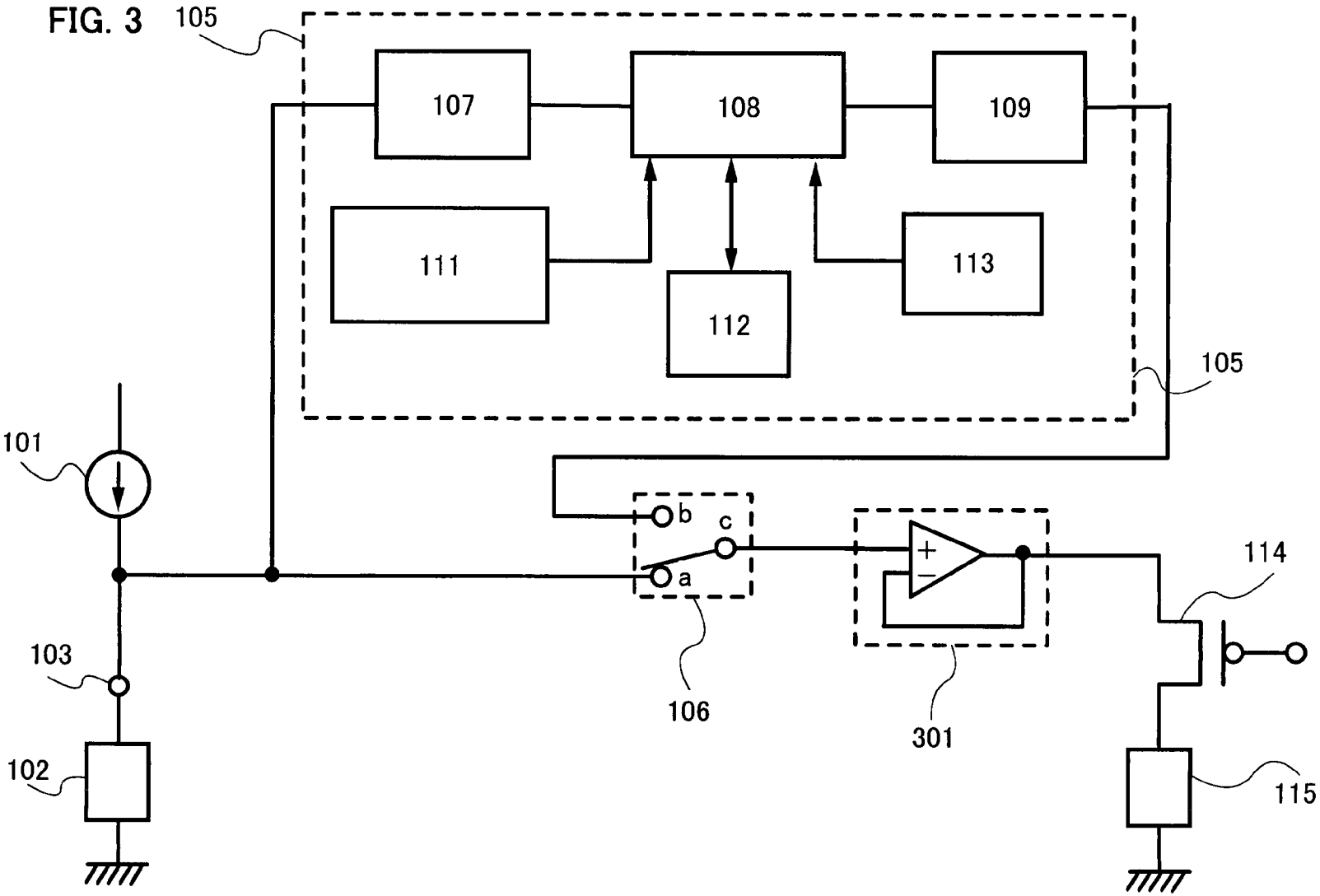
FIG. 3 illustrates a compensation circuit applicable to an active matrix display device.

In addition, the amplifier 104 and the amplifier 110 can be replaced by one amplifier 301 by disposing the switch 106 on the input terminal side of the amplifier 301 as shown in FIG. 3. In addition, to the amplifiers 104 and 110, a voltage follower circuit using an operational amplifier can be applied as is applied to the amplifier 301. This is because a non-inverting input terminal of a voltage follower circuit has a high input impedance while an output terminal thereof has a low output impedance, which allows the input terminal and the output terminal to have the same or substantially the same potential, thereby a current can be supplied from the output terminal without a current from the current source 101 flowing to the voltage follower circuit. That is, impedance conversion can be carried out. Accordingly, it is needless to mention that the invention is not limited to the voltage follower circuit as long as a circuit having such a function is provided. In addition, the impedance conversion is not necessarily required to be performed by the amplifiers 104 and 110 or the amplifier 301 as long as an alternative amplifier outputting from the output terminal substantially the same potential as the potential inputted to the input terminal is used. Accordingly, a voltage feedback amplifier or a current feedback amplifier may be appropriately used for the amplifiers 104, 110 and 301.

Figure 4:
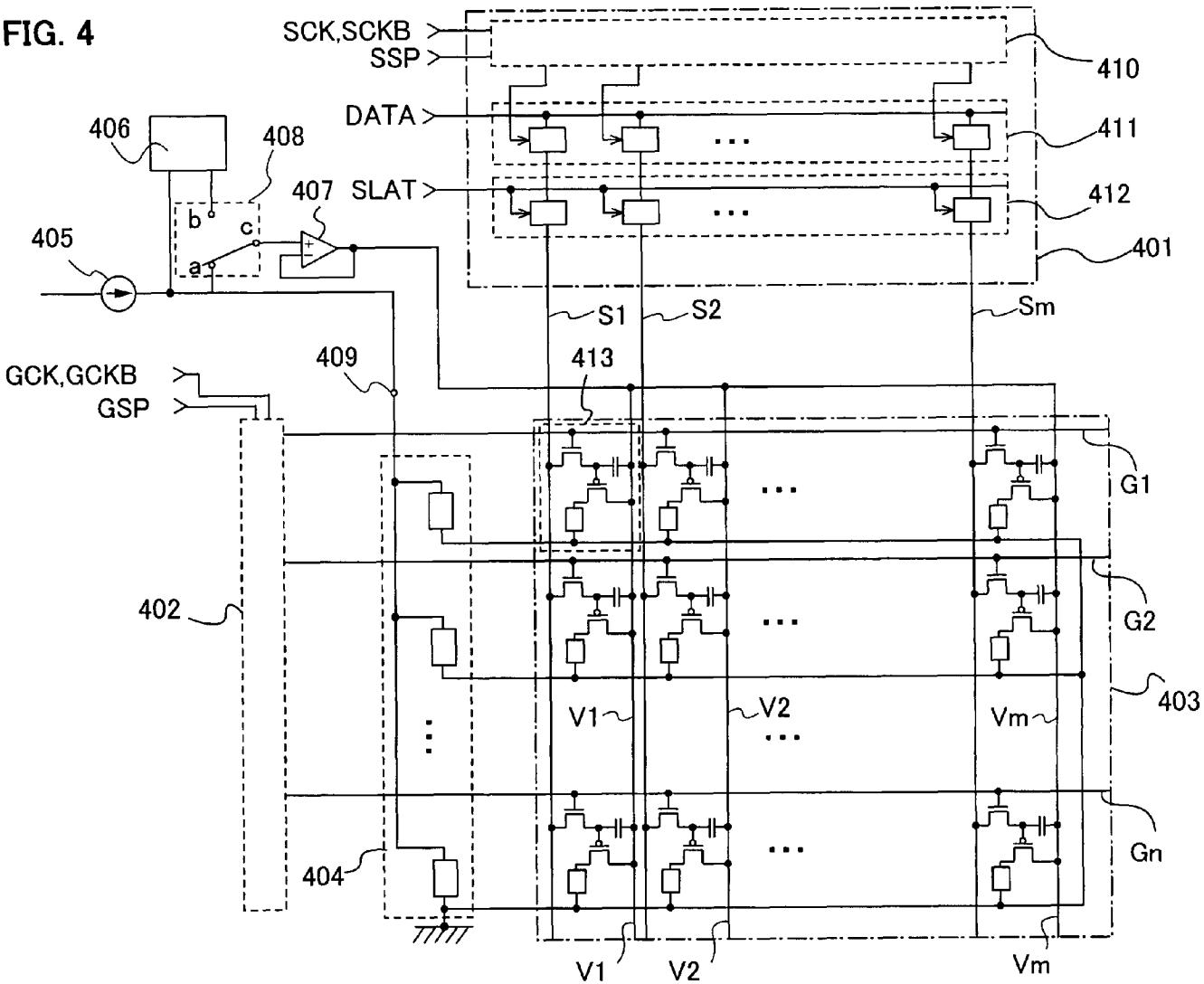
FIG. 4 is a schematic diagram of an active matrix display device having a compensation circuit.

Description is made below with reference to FIG. 4 on a specific configuration of a display device having a compensation function. The display device includes a source signal line driver circuit 401, a gate signal line driver circuit 402 and a pixel portion 403. The pixel portion 403 has a plurality of pixels 413. The display device also includes a monitoring element group 404, a basic current source 405, an extrapolation power supply circuit 406, an amplifier 407 and a switch 408. A current is supplied from the basic current source 405 to the monitoring element group 404. Then, a voltage drops in each monitoring element included in the monitoring element group 404. That is, as each monitoring element included in the monitoring element group 404 has a resistance value, a voltage drop occurs. Cathodes of monitoring elements of the monitoring element group 404 are connected to GND; therefore, data on the voltage generated in the monitoring elements of the monitoring element group 404 can be obtained by detecting a potential of an anode 409. Note that by providing a plurality of monitoring elements as shown in FIG. 4, variations in the voltage drop resulting from the variations in the resistance value of each monitoring element can be averaged. In addition, the connection of the switch 408 is switched according to a specific condition (e.g., voltage change or time change), and the extrapolation circuit 406 determines the potentials to be supplied to power supply lines V1 to Vm based on the data obtained by obtaining mathematical formula of the change of a voltage generated in the monitoring element group 404. The detailed operation thereof is omitted as it is already described with reference to FIGS. 1 and 3.

The source signal line driver circuit 401 includes a pulse output circuit 410, a first latch circuit 411 and a second latch circuit 412. SCK signals, SCKB signals and SSP signals are inputted to the pulse output circuit 410, and output signals of the pulse output circuit 410 are sequentially inputted to the first latch circuits 411 corresponding to source signal lines S1 to Sm. Then, DATA signals are inputted serially to the first latch circuits 411. The serial DATA signals are latched in parallel by the first latch circuits 411 in stages in accordance with the signals sequentially inputted from the pulse output circuit 410. Then, the DATA signals latched in parallel are transferred to the second latch circuits 412 at the input timing of SLAT signals. Then, the DATA signals which are held in parallel are written to pixels connected to the selected gate signal lines.

Figure 1:
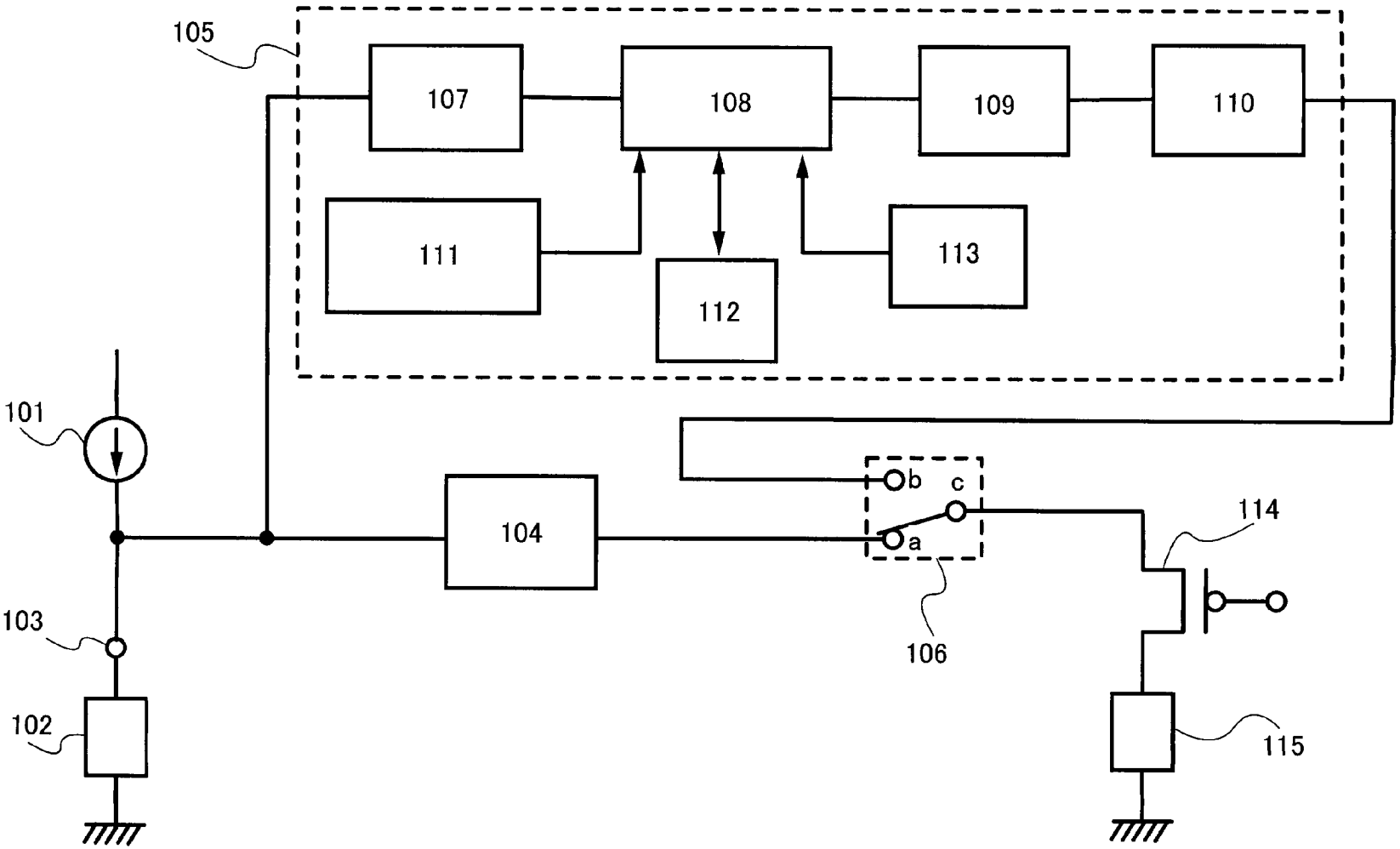
FIG. 1 illustrates a compensation circuit applicable to an active matrix display device.

Description is made below on a configuration of a switch and the operation principle thereof, which can be used as the switch 106 having three terminals as shown in FIGS. 1 and 3 and the switch 408 as shown in FIG. 4.

Figure 5:
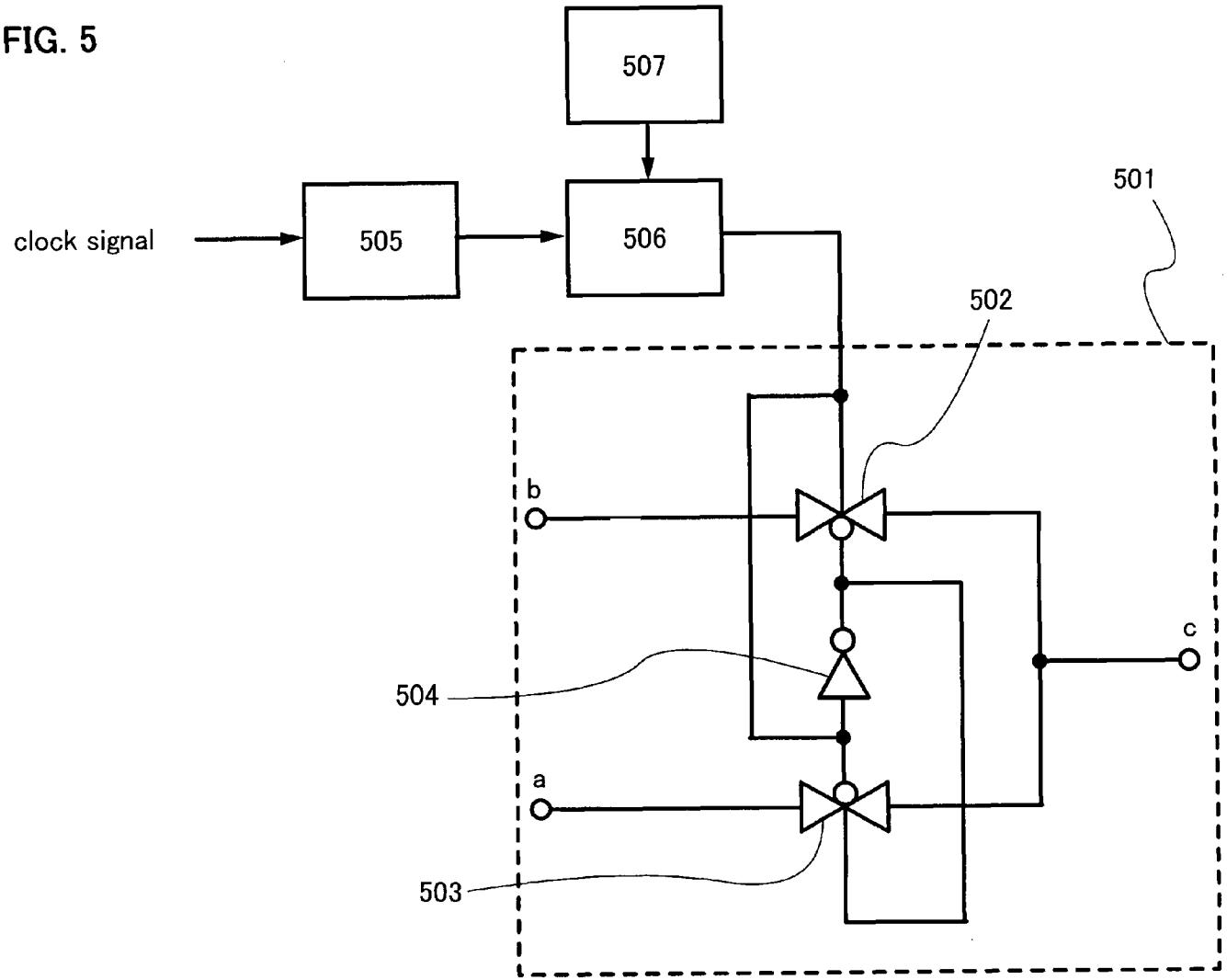
FIG. 5 illustrates a switch for switching a power supply source.

FIG. 5 illustrates an example of the switch for switching power supplies after a certain period of time has passed. A switch 501 includes an analog switch 502, an analog switch 503 and an inverter 504. Control signals for controlling the switch 501 are generated by a determination circuit 506. Clock signals are counted by a counter circuit 505 and the data thereof is inputted as a signal to the determination circuit 506. Then, a signal recorded in a determination reference value memory (memory in which a reference value for determination is stored) 507 is compared with the signal from the counter circuit 505 in the determination circuit 506. When the signal value of the determination reference value memory 507 is larger than the signal value of the counter circuit 505, the determination circuit 506 outputs an L-level signal, thereby the analog switch 502 is turned OFF and the analog switch 503 is turned ON. That is, terminals a and c of the switch 501 are connected until the signal value of the counter circuit 505 surpasses a value of the determination reference value memory 507 (that is, until a certain period of time has passed). Then, when the signal value of the counter circuit 505 becomes larger than the value stored in the determination reference value memory 507, an H-level signal is outputted from the determination circuit 506, thereby the analog switch 502 is turned ON and the analog switch 503 is turned OFF. That is, terminals b and c of the switch 501 are connected after a certain period of time has passed. In this manner, after a preset time has passed, a voltage supply source of a light-emitting element can be switched to the extrapolation power supply circuit 105 or 406.

Description is made below with reference to FIGS. 6 and 7 on the operation of a switch having three terminals in the case where a power supply is switched after the input potential surpasses a certain voltage value. The configuration of the switch 501 is similar to that of FIG. 5; therefore, the description thereof is omitted. In this case, an operational amplifier 601 can be used as a generator of control signals. A potential of an anode of a monitoring element is inputted as an input potential to a non-inverting input terminal of the operational amplifier 601. Meanwhile, a reference potential is inputted to an inverting input terminal thereof. Here, a potential of VDD2 shown in FIG. 2B is inputted as the reference potential. Thus, if the input potential is lower than VDD2, the operational amplifier 601 outputs an L-level signal, thereby the analog switch 502 is turned OFF and the analog switch 503 is turned ON. That is, the terminals a and c of the switch 501 are connected. When the input potential becomes higher than VDD2, the operational amplifier 601 outputs an H-level signal, thereby the analog switch 502 is turned ON and the analog switch 503 is turned OFF. That is, the terminals b and c of the switch 501 are connected. In this manner, when the input potential surpasses a preset potential (VDD2 in FIG. 6), a voltage supply source of a light-emitting element can be switched to the extrapolation power supply circuit 105 or 406.

Figure 6:
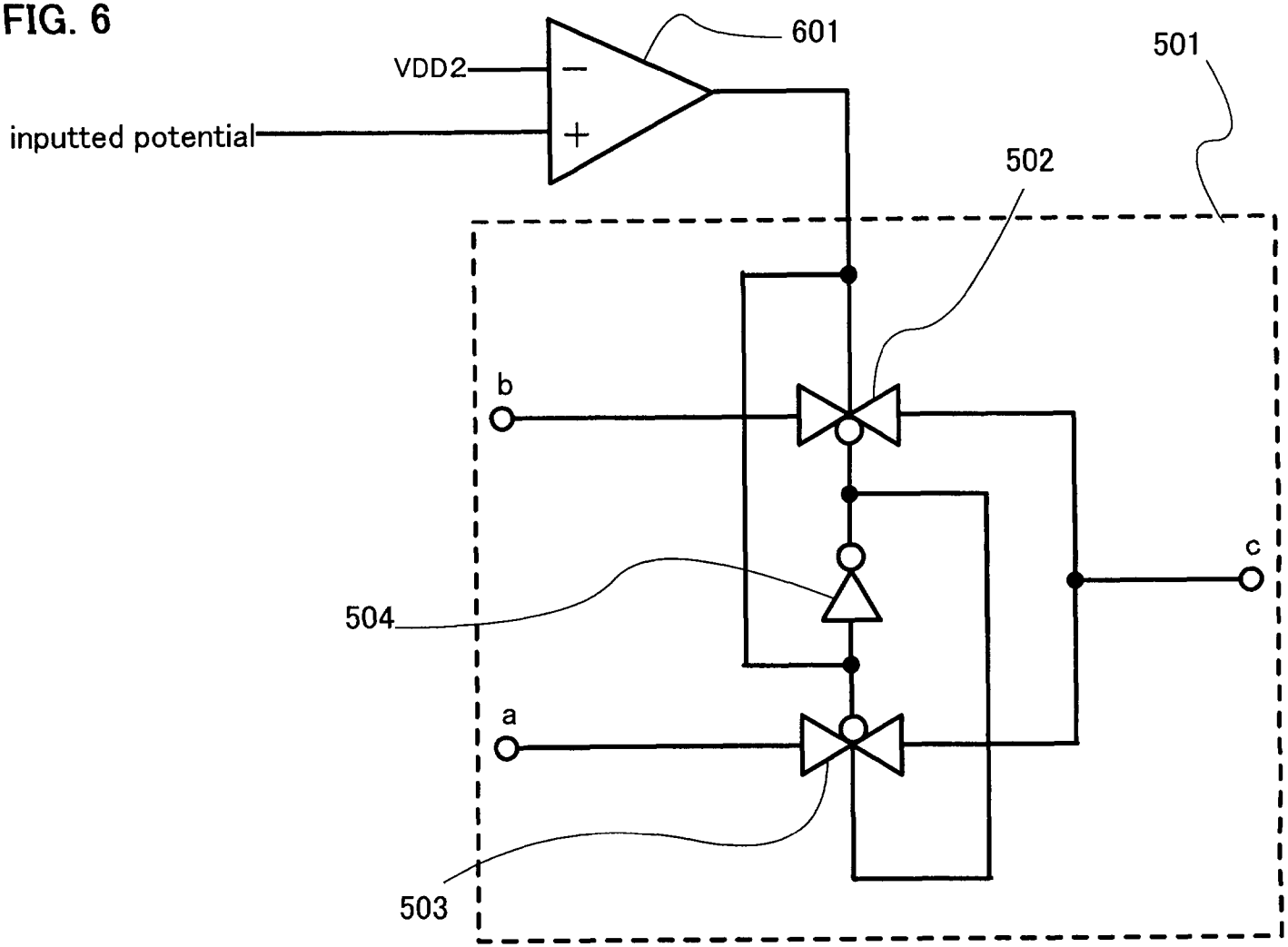
FIG. 6 illustrates a switch for switching a power supply source.
Figure 7:
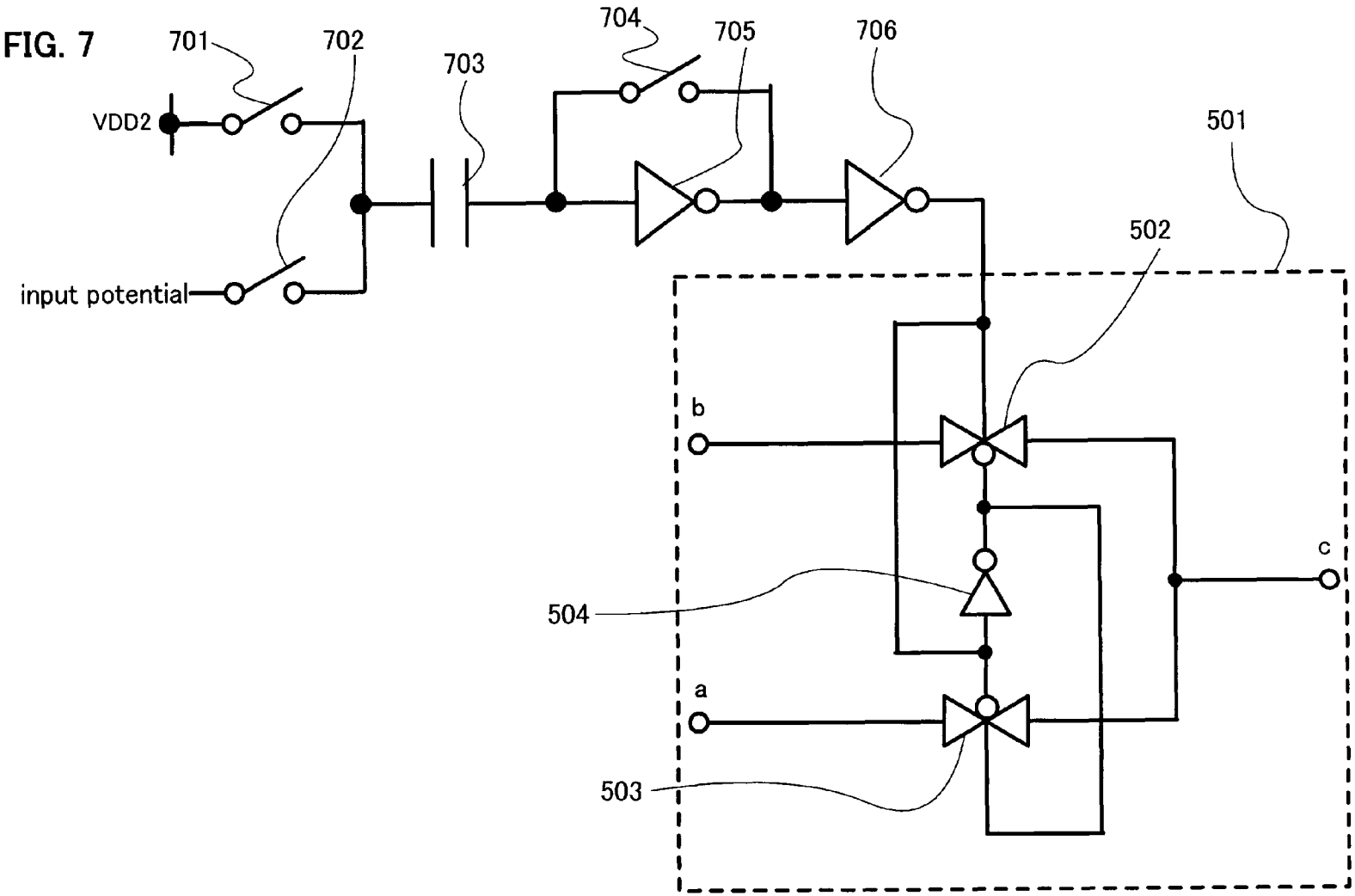
FIG. 7 illustrates a switch for switching a power supply source.

In addition, as shown in FIG. 7, control signals may be generated by using a chopper inverter comparator in stead of the operational amplifier in FIG. 6. First, a switch 704 is turned ON to short-circuit an input terminal and an output terminal of an inverter 705. Then, the inverter 705 is offset-cancelled, thereby the input terminal and the output terminal thereof have the same potential. Subsequently, in such a state, a switch 701 is turned ON. Then, charges for a potential difference between the potential of the inverter 705 with offset-cancelled and the reference potential VDD2 are accumulated in a capacitor 703. When the switch 701 is turned OFF, the capacitor 703 holds the potential difference. Then, the switch 704 is turned OFF, and a switch 702 is turned ON. Then, when the input potential is lower than VDD2 as a preset potential, the potential of the input terminal of the inverter 705 is lower than the potential at which the inverter 705 is offset-cancelled since the potential difference is held in the capacitor 703. That is, an L-level signal is inputted to the input terminal of the inverter 705, and an H-level signal is outputted from the output terminal thereof, which is further inverted by an inverter 706. Thus, an L-level signal is inputted as a control signal to the switch 501. At this time, the analog switch 502 is turned OFF and the analog switch 503 is turned ON. Thus, the terminals a and c of the switch 501 are connected. On the other hand, if the input potential is higher than the reference potential VDD2, the input terminal of the inverter 705 is higher than the potential at which the inverter 705 is offset-cancelled since the potential difference is held in the capacitor 703. Then, an H-level signal is inputted to the inverter 705, and the signal is inverted in the inverter 706. Thus, an H-level signal is inputted as a control signal to the switch 501. Then, the analog switch 502 is turned ON and the analog switch 503 is turned OFF. Thus, the terminals b and c of the switch 501 are connected. In this manner, when the potential of the monitoring element becomes higher than a preset potential (VDD2 in FIG. 7), a voltage supply source of a light-emitting element can be switched to the extrapolation power supply circuit 105 or 406.

Such a driving method having a temperature compensation function and a degradation compensation function like the invention is also called constant brightness.

Note that the number of the monitoring elements can be selected appropriately. Needless to say, either a single monitoring element or a plurality of monitoring elements may be provided as shown in FIG. 4. When using a single monitoring element, a current flown to the basic current source 101 may be set to have a current value which is to be supplied to a light-emitting element in each pixel; therefore, power consumption can be reduced.

In addition, the invention is not limited to the configuration in FIG. 4, and such a configuration may be adopted that a monitoring element is disposed on the side of a source signal line driver circuit, disposed on the opposite side of a gate signal line driver circuit across a pixel portion, or disposed on the opposite side of the source signal line driver circuit across the pixel portion. In order to accomplish the temperature compensation function effectively, the position of the monitoring element can be appropriately selected.

The monitoring element and the light-emitting element are preferably formed over the same substrate simultaneously using the same material. This is because variations of the V-I characteristics of the monitoring element and the light-emitting element can be decreased.

Note that the configuration in which a common potential is inputted to the power supply lines Vi to Vm as in FIG. 4 is preferably applied to a monochromatic display device or a display device capable of full-color display in combination with white-light-emitting elements and color filters.

Figure 8:
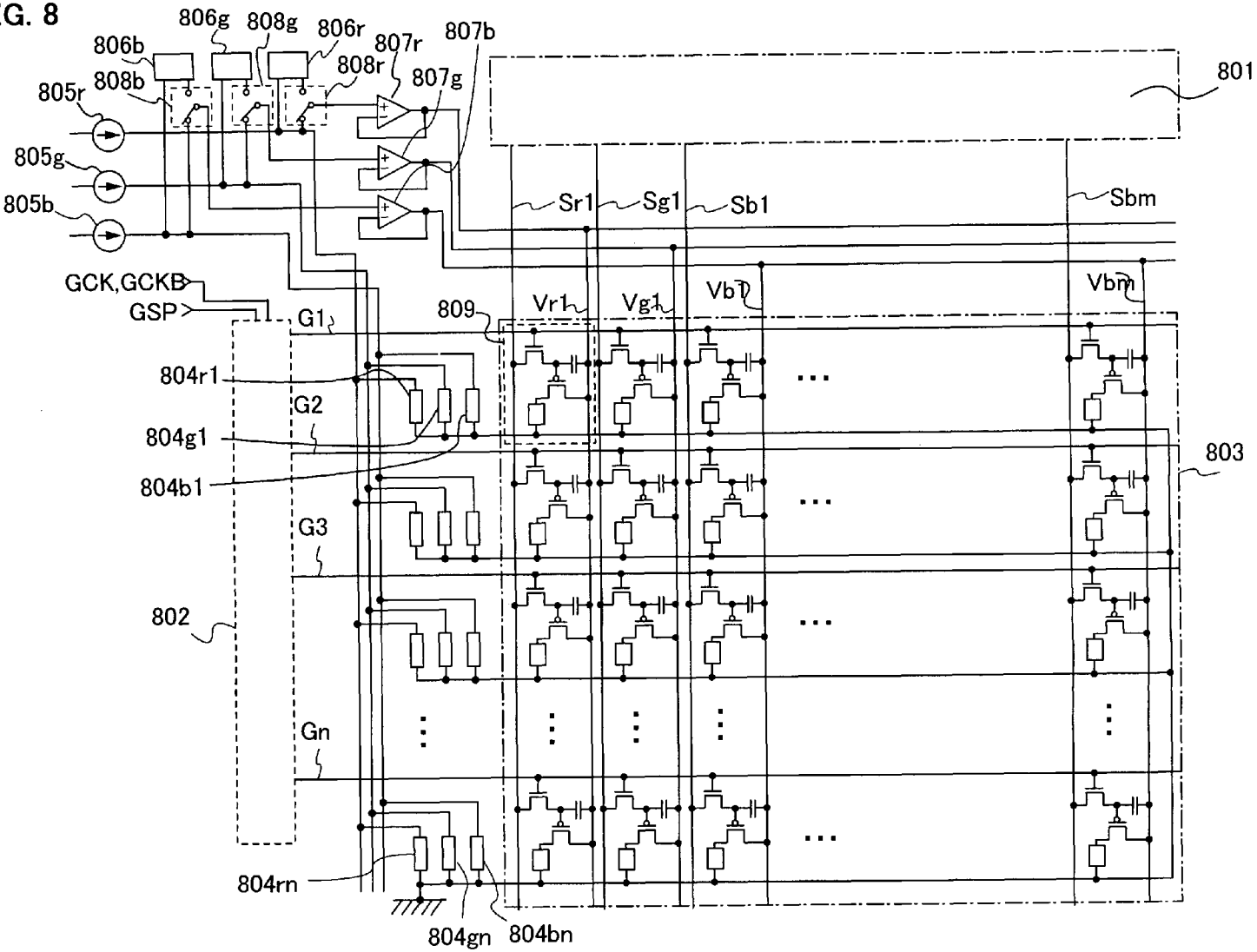
FIG. 8 is a schematic diagram of an active matrix display device having a compensation circuit.

In addition, potentials of power supply lines may be set for each of the RGB pixels. FIG. 8 illustrates an example of such a case. A display device in FIG. 8 includes a source signal line driver circuit 801, a gate signal line driver circuit 802 and a pixel portion 803 which includes a plurality of pixels 809.

Source signal lines connected to the pixels for R (Red) emission are shown by source signal lines Sr1 to Srm. Source signal lines connected to the pixels for G (Green) emission are shown by source signal lines Sg1 to Sgm. Source signal lines connected to the pixels for B (Blue) emission are shown by source signal lines Sb1 to Sbm.

Here, a current source 805*r* supplies a current to monitoring elements 804*r*1 to 804*rn*, and a voltage follower circuit 807*r* detects potentials of anodes of the monitoring elements 804*r*1 to 804*rn*. Then, the detected potentials are inputted to power supply lines Vr1 to Vrm. A current source 805*g* supplies a current to monitoring elements 804*g*1 to 804*gn*, and a voltage follower circuit 807*g* detects potentials of anodes of the monitoring elements 804*g*1 to 804*gn*. Then, the detected potentials are inputted to power supply lines Vg1 to Vgm. A current source 805*b* supplies current to monitoring elements 804*b*1 to 804*bn*, and a voltage follower circuit 807*b* detects potentials of anodes of the monitoring elements 804*b*1 to 804*bn*. Then, the detected potentials are inputted to power supply lines Vb1 to Vbm.

In this manner, potentials can be set for each of the RGB pixels. For example, a desired potential can be inputted to each light-emitting element when the temperature characteristics or the degradation characteristics of the RGB pixels differ depending on the EL materials thereof. That is, by setting potentials of the power supply lines for each of the RGB pixels, a current value flowing to each light-emitting element, which fluctuates due to the temperature change and degradation with time, can be corrected. In addition, provided that a certain condition is preset and the condition is satisfied, the switches 808*r*, 808*g* and 808*b* are switched so that potentials are inputted to the power supply lines Vr1 to Vrm from the extrapolation power supply circuit 806*r*, potentials are inputted to the power supply lines Vg1 to Vgm from the extrapolation power supply circuit 806*b*, and potentials are inputted to the power supply lines Vb1 to Vbm from the extrapolation power supply circuit 806*b*. In this manner, even when the display device is continuously used, causing monitoring elements 804*r*1 to 804*rn*, 804*g*1 to 804*gn* and 804*b*1 to 804*bn* to break down, potentials are inputted to the power supply lines Vr1 to Vrm, Vg1 to Vgm and Vb1 to Vbm from the extrapolation power supply circuits 806*r*, 806*g* and 806*b* respectively. Thus, the display device can operate normally. In addition, by inputting potentials from the extrapolation power supply circuits 806*r*, 806*g* and 806*b*, the current value of the light-emitting element which fluctuates due to the temperature change and degradation with time can be corrected.

Next, description is made on a pixel configuration which can be used for the display device of this embodiment mode. Note that the invention is not limited to the pixel configurations shown in FIGS. 4 and 8, and other pixel configurations in which voltage-drive type transistors are used as the pixel transistors can be applied. That is, the invention can be applied to a display device having a pixel configuration in which transistors operating in the linear region are used as the driving transistors of the light-emitting elements.

Figure 14B:
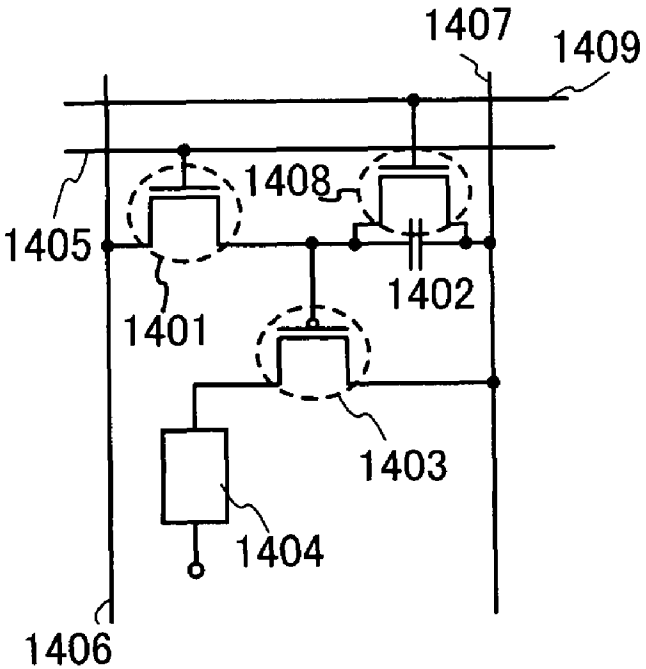
FIGS. 14A and 14B illustrate examples of a pixel configuration applicable to the active matrix display device of the invention.
Figure 14A:
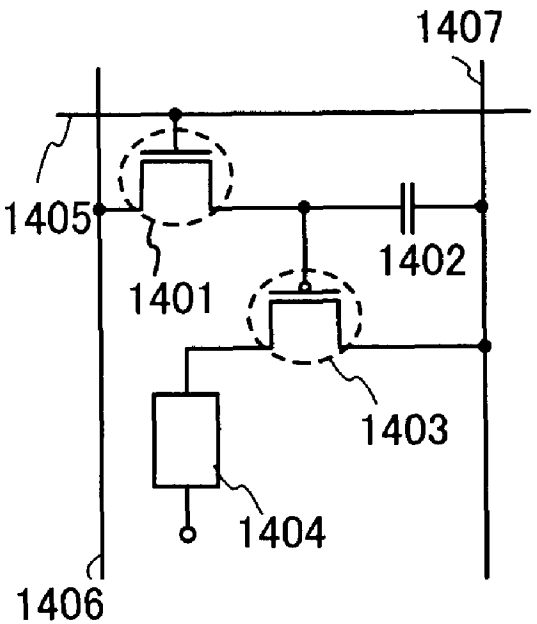

First, description is made with reference to FIG. 14A on the operation of the pixel configuration of the display device shown in FIGS. 4 and 8. The pixel includes a switching transistor 1401, a capacitor 1402, a driving transistor 1403, a light-emitting element 1404, a gate signal line 1405, a source signal line 1406 and a power supply line 1407. A gate terminal of the switching transistor 1401 is connected to the gate signal line 1405. A source terminal of the switching transistor 1401 is connected to the source signal line 1406 while a drain terminal thereof is connected to a gate terminal of the driving transistor 1403. In addition, one terminal of the capacitor 1402 is connected to the gate terminal of the driving transistor 1403 while the other terminal thereof is connected to the power supply line 1407. A source terminal of the driving transistor 1403 is also connected to the power supply line 1407, and a drain terminal thereof is connected to an anode of the light-emitting element 1404. When the switching transistor 1401 is turned ON by a signal inputted from the gate signal line 1405, a digital video signal is inputted to the gate terminal of the driving transistor 1403 from the source signal line 1406. A voltage of the inputted digital video signal is held in the capacitor 1402. By the inputted digital video signal, ON/OFF of the driving transistor 1403 is selected to control whether or not to input a potential inputted from the power supply line 1407 to the anode of the light-emitting element 1404. By setting the potential of the power supply line 1407 in accordance with the invention, the current value of the light-emitting element 1404 which fluctuates due to the temperature change and degradation with time can be corrected. Further, a stable voltage supply source can be provided.

In addition, the invention can be applied to a display device having the pixel configuration as shown in FIG. 14B. The configuration of FIG. 14B corresponds to that having the configuration realized by additionally providing that of FIG. 14A with an erasing transistor 1408 and an erasing signal line 1409. Accordingly, common portions between FIGS. 14A and 14B are denoted by common reference numerals. In the configuration, when an erasing signal is inputted to the erasing signal line 1409 to turn ON the erasing transistor 1408, charge held in the capacitor 1402 is released to turn OFF the driving transistor 1403, thereby the light-emitting element 1404 can be brought to emit no light. In this configuration also, by setting the potential of the power supply line 1407 in accordance with the invention, the current value of the light-emitting element 1404 which fluctuates due to the temperature change and degradation with time can be corrected. Further, a stable voltage supply source can be provided.

In addition, the invention is not limited to the aforementioned configurations, and the invention can be applied to such a pixel configuration that conductivity type of a transistor in a pixel is changed, connection is changed, or additional transistors are provided.

Embodiment Mode 2

In Embodiment Mode 1, description is made on an active matrix display device (also referred to as an active display device); however, the invention can be applied to a passive matrix display device (also referred to as a passive display device) as well. Therefore, in this embodiment mode, description is made on the case where the compensation circuit of the invention is applied to a passive matrix display device.

Description is made below with reference to FIG. 9 on a configuration and operation of a column signal line driver circuit and a compensation circuit. A column signal line driver circuit 913 shown in FIG. 9 can control the period in which potentials inputted from a temperature/degradation compensation circuit (hereinafter simply referred to as a compensation circuit) are outputted to column signal lines S1, S2 . . . , thereby time gray scale display can be performed.

First, terminals a and c of a switch 906 are connected. Then, a current source 901 supplies a constant current to a monitoring element 902. That is, the monitoring element 902 is driven with a constant current. Then, a potential of an anode 903 of the monitoring element 902 is detected by an amplifier 904, and outputted to the column signal lines S1, S2 . . . . Note that the amplifier 904 may be, for example, a voltage follower circuit.

In addition, pulses are outputted from a pulse output circuit 914, in accordance with which DATA signals are sequentially held in first latch circuits 915. Then, the data held in the first latch circuits 915 is transferred to a second latch circuit 916 at the input timing of SLAT signals. Then, the data held in the second latch circuits 916 controls the ON period of switches 917*a*1, 917*a*2 . . . , thereby setting the periods for supplying potentials to the column signal lines S1 to Sn, that is, the periods for supplying potentials to the light-emitting elements. In this manner, time gray scale display can be performed.

Note that in the case of actually displaying 3-bit gray scales, for example, the first latch circuits 915 and the second latch circuits 916 each have three latch circuits. Then, the 3-bit data outputted from the second latch circuit 916 is converted to signals having pulse widths for the case of displaying 8-level gray scale, and the switches 917*a*1, 917*a*2 . . . are turned ON in the period of the pulse widths. In this manner, 8-level gray scale can be displayed.

In addition, according to a preset condition, the connection of the switch 906 is switched, thereby a voltage generated by an extrapolation power supply circuit 905 is impedance-converted by the amplifier 904 so that the potential is inputted to the column signal lines.

Note that analog data including the voltage generated in the monitoring element 902 is converted to digital data in an A/D converter circuit 907, and then inputted to a voltage-mathematization circuit 908. A temperature-characteristic-detection monitoring circuit 910 monitors the temperature, and inputs the detected temperature data to the voltage-mathematization circuit 908. In addition, data on the emission period of the monitoring element 902 which is counted by a counter circuit 912 is inputted to the voltage-mathematization circuit 908. Based on such data, the voltage-mathematization circuit 908 mathematizes the voltage according to each temperature condition. Then, the mathematized data is stored in a memory circuit 911. The voltage-mathematization circuit 908 calculates a voltage to be inputted to the column signal lines S1, S2 . . . based on the data obtained by obtaining mathematical formula of the voltage change of the monitoring element 902 which is stored in the memory circuit 911, the temperature condition monitored by the temperature-characteristic-detection monitoring circuit 910, and the time condition inputted from the counter circuit 912. Then, digital data of the voltage obtained by the calculation is converted to an analog voltage by a D/A converter circuit 909. In this manner, fluctuation of current values flowing to the light-emitting element due to the temperature change and degradation with time can be decreased.

Figure 9:
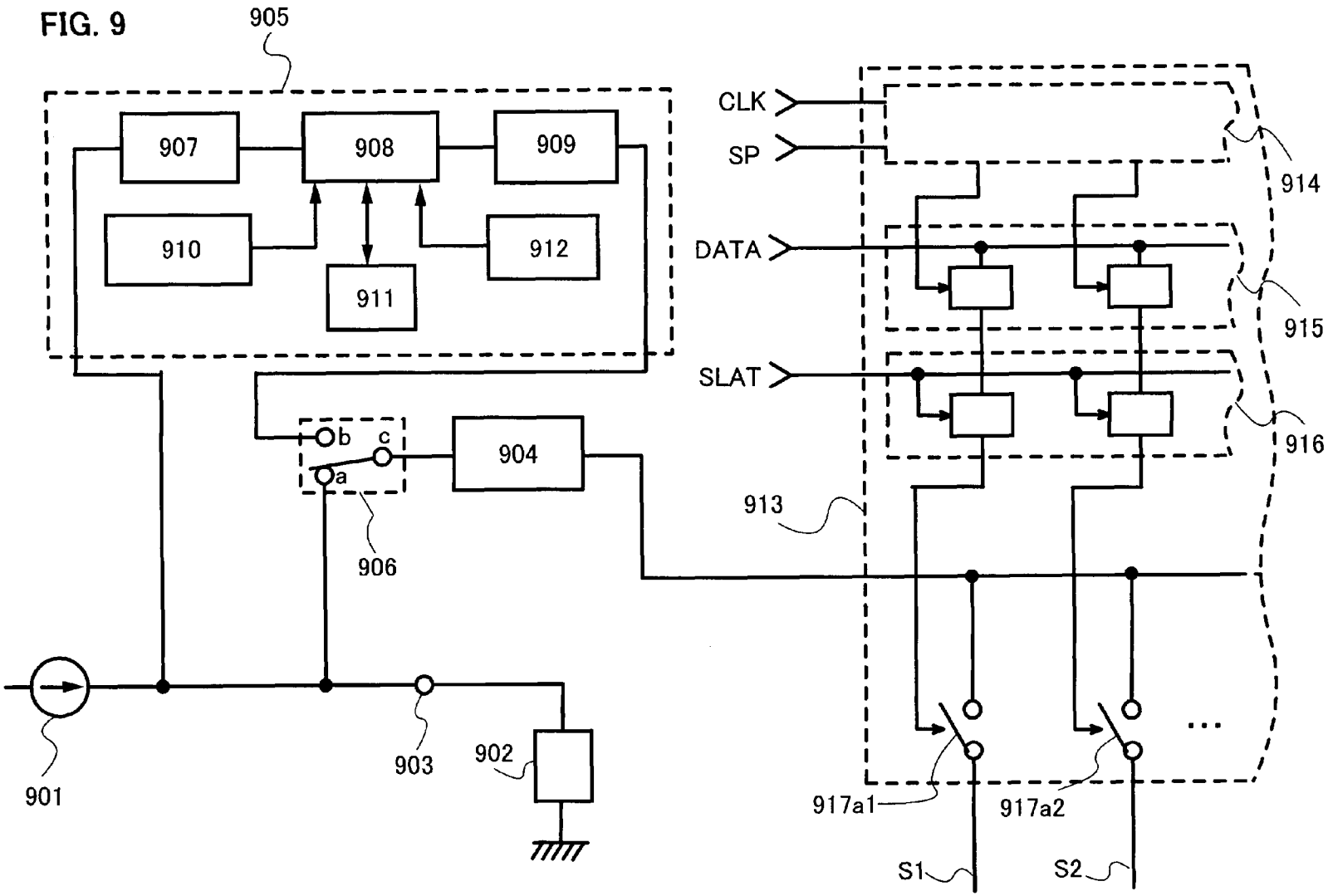
FIG. 9 illustrates a compensation circuit applicable to a passive matrix display device.
Figure 10:
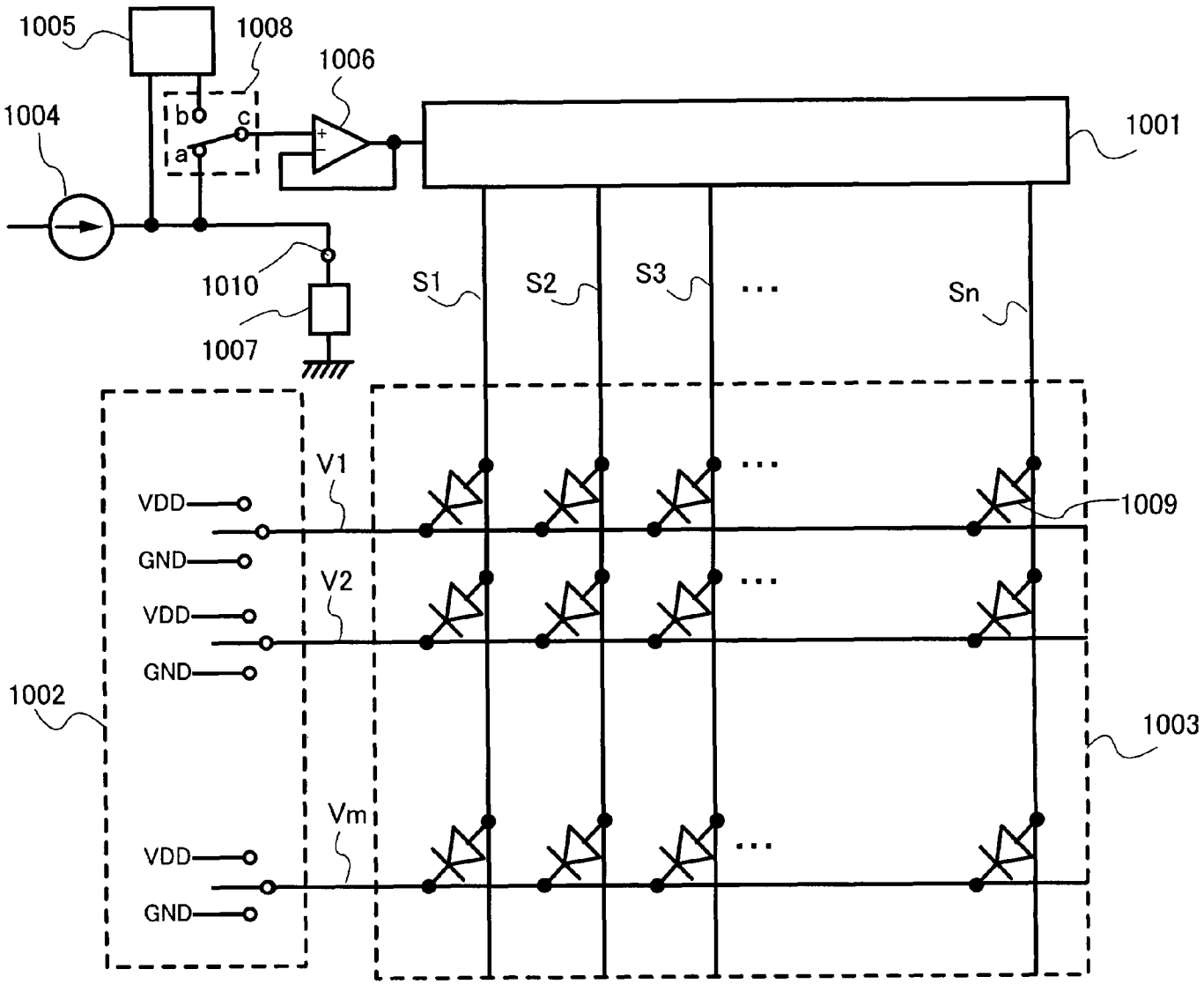
FIG. 10 is a schematic diagram of a passive matrix display device having a compensation circuit.

FIG. 10 illustrates an example in which the column signal line driver circuit of FIG. 9 is applied to a display device. The display device includes a column signal line driver circuit 1001, a row signal line driver circuit 1002 and a pixel portion 1003. By the row signal line driver circuit 1002, one of row signal lines V1 to Vm is selected. That is, one row signal line is set so that a current flows to a light-emitting element 1009 by the potential difference between the potentials inputted to the row signal line and the column signal line. Then, the potential difference between the potentials inputted to the selected row signal line and column signal line is applied to the light-emitting element 1009 interposed between the row signal line and the column signal line. Then, the light-emitting element 1009 emits light with a current flow. At this time, although the potential inputted to each of the column signal lines S1 to Sn is set to have the same level, the period in which the potential is inputted is different. In this manner, time gray scale display can be performed.

In the invention, a constant current is supplied from a current source 1004 to a monitoring element 1007. That is, constant current drive is performed. Terminals a and c of a switch 1008 are connected until a preset condition (e.g., time or voltage) is satisfied. Then, a potential of an anode 1010 of the monitoring element 1007 is detected, thereby potentials supplied to column signal lines are set by a voltage follower circuit 1006. In this manner, a display device having a temperature and degradation compensation function can be provided.

Then, when the preset condition is satisfied, the connection of the switch 1008 is switched, thereby terminals b and c of the switch 1008 are connected. Then, a potential generated by the extrapolation power supply circuit 1005 is inputted to the column signal lines S1 to Sn by the voltage follower circuit 1006.

In this manner, by switching a voltage supply source, the display device can normally operate even when the monitoring element 1007 breaks down due to the continuous use thereof. In addition, changes with time of the voltage generated in the monitoring element 1007 are mathematized according to each temperature condition, based on which the extrapolation power supply circuit 1005 generates potentials. Therefore, changes caused by temperature and degradation can be compensated.

Note that the number of the monitoring elements can be selected appropriately. Needless to say, either a single monitoring element as shown in FIG. 10 or a plurality of monitoring elements may be provided. When using a single monitoring element, the current source 1004 is only required to set a current value which is to be supplied to the light-emitting element 1109 in each pixel; therefore, power consumption can be reduced.

Alternatively, a plurality of monitoring elements can be connected in parallel, or the same number of monitoring elements as that of row signal lines may be provided, in which case cathodes of the monitoring elements are connected to the row signal lines respectively. In addition, such a configuration may be adopted that a monitoring element is disposed on the side of a row signal line driver circuit or a column signal line driver circuit, disposed on the opposite side of the row signal line driver circuit across a pixel portion, or disposed on the opposite side of the column signal line driver circuit across the pixel portion. In order to accomplish the temperature compensation function effectively, the position of the monitoring element can be appropriately selected.

The monitoring element and the light-emitting element are preferably formed over the same substrate simultaneously using the same material. This is because variations in the V-I characteristics of the monitoring element and the light-emitting element can be decreased.

Note that the configuration in which a common potential is inputted to each column signal line as in FIG. 10 is preferably applied to a monochromatic display device or a display device capable of full-color display in combination with white-light-emitting elements and color filters.

Figure 13:
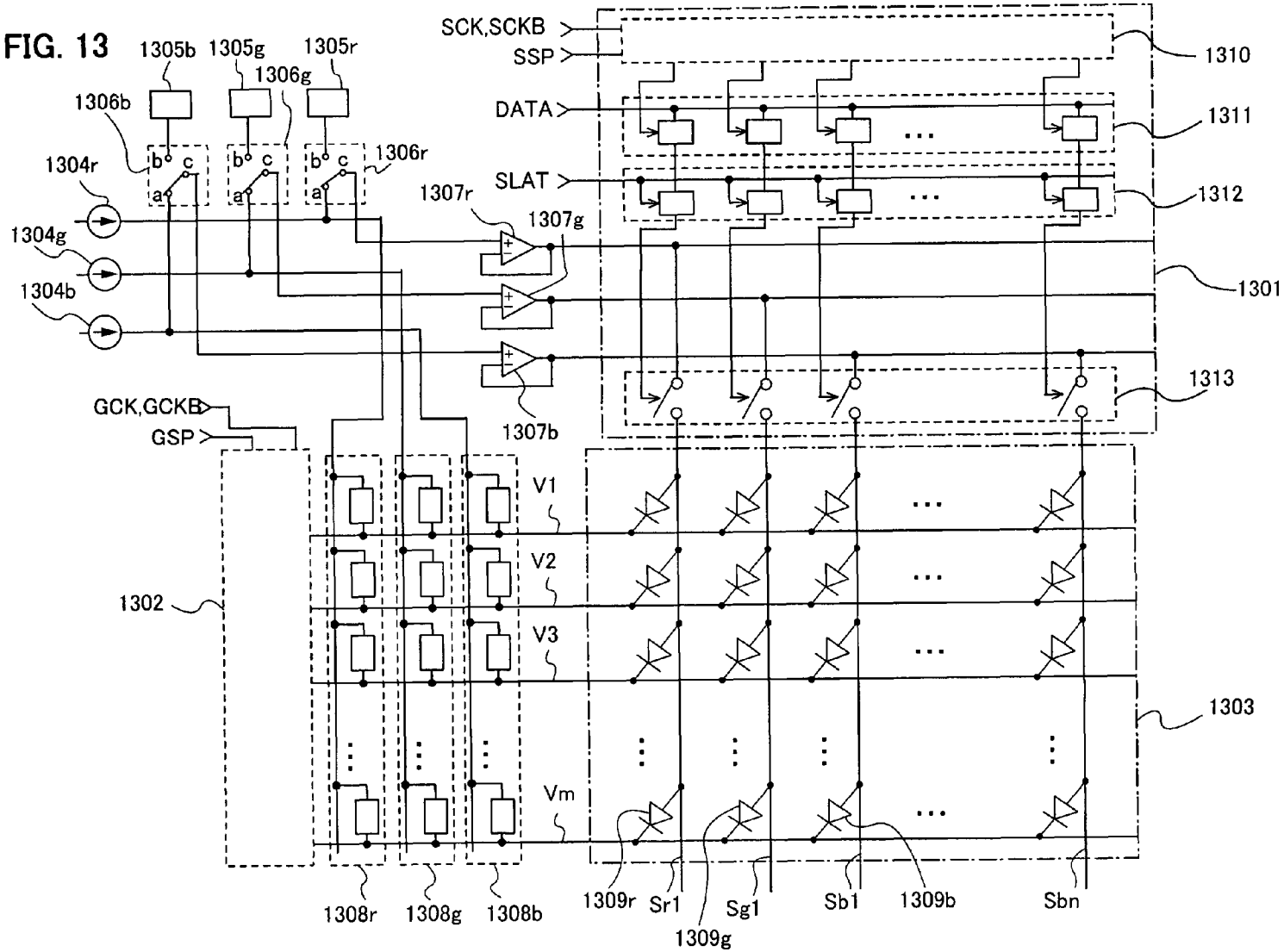
FIG. 13 is a schematic diagram of a passive matrix display device having a compensation circuit.

In addition, potentials of pixels connected to power supply lines may be set corresponding to RGB colors. FIG. 13 illustrates an example of such a case.

A display device in FIG. 13 includes a column signal line driver circuit 1301, a row signal line driver circuit 1302 and a pixel portion 1303 which includes an R (Red) pixel 1309*r*, a G (Green) pixel 1309*g* and a B (Blue) pixel 1309*b*.

Signal lines connected to the pixels for R (Red) emission are shown by signal lines Sr1 to Srm. Signal lines connected to the pixels for G (Green) emission are shown by signal lines Sg1 to Sgm. Signal lines connected to the pixels for B (Blue) emission are shown by signal lines Sb1 to Sbm.

Brief description is made on the operation of the column signal line driver circuit in FIG. 13. Pulses are outputted from a pulse output circuit 1310, in accordance with which DATA signals are sequentially inputted to first latch circuits 1311. Then, the data held in the first latch circuits 1311 is transferred to second latch circuits 1312 at the input timing of SLAT signals. Then, the data held in the second latch circuit 1312 controls the ON period of switches 1313, thereby setting the period for supplying the outputs of voltage follower circuits 1307*r*, 1307*g* and 1307*b* to column signal lines Sr1 to Sm, Sg1 to Sgn and Sb1 to Sbn respectively (namely, the emission period of light-emitting elements in one horizontal period). In this manner, time gray scale display can be performed.

In the invention, current sources 1304*r*, 1304*g* and 1304*b* flow constant currents to monitoring element groups 1308*r*, 1308*g* and 1308*b* respectively. That is, the monitoring element groups 1308*r*, 1308*g* and 1308*b* are driven with a constant current. Then, terminals a and c of respective switches 1306*r*, 1306*g* and 1306*b* are connected until a preset condition (e.g., time or voltage) is satisfied. Then, potentials of anodes of the monitoring element groups 1308*r*, 1308*g* and 1308*b* are each detected, thereby potentials to be supplied to the column signal lines are set by the voltage follower circuits 1307*r*, 1307*g* and 1307*b*. In this manner, a display device having a temperature and degradation compensation function can be provided.

In this manner, potentials can be set for each of the RGB pixels. For example, when the temperature characteristics or the degradation characteristics of the RGB pixels differ depending on the EL materials, a desired potential can be inputted to each light-emitting element. That is, potentials of column signal lines can be set and corrected for each of the RGB pixels.

In addition, provided that a preset condition is satisfied, the connection of the switches 1306*r*, 1306*g* and 1306*b* is switched, thereby the terminals b and c thereof are each connected. Then, potentials generated by extrapolation power supply circuits 1305*r*, 1305*g* and 1305*b* are inputted to the column signal lines Sr1 to Sm, Sg1 to Sgn and Sb1 to Sbn from the voltage follower circuits 1307*r*, 1307*g* and 1307*b* respectively.

In this manner, by switching voltage supply sources, the displaying device can operate normally even when the monitoring element groups 1308*r*, 1308*g* and 1308*g* break down due to the continuous use thereof. In addition, changes with time of the voltage generated in the monitoring element groups 1308*r*, 1308*g* and 1308*b* are anathematized according to each temperature condition, based on which the extrapolation power supply circuits 1305*r*, 1305*g* and 1305*b* generate voltages. Therefore, temperature and degradation can be compensated.

In the configuration of FIG. 13, only one monitoring element is connected to each of the row signal line, the cathode of each monitoring element included in the monitoring element groups 1308*r*, 1308*g* and 1308*b* is connected to the row signal line, and thus only one monitoring element emits light for each of the RGB pixels. However, when connecting each monitoring element included in the monitoring element groups 1308*r*, 1308*g* and 1308*b* in parallel to the RGB pixels, voltages generated in the monitoring elements for each of RGB can be averaged.

Embodiment Mode 3

Description is made below on the panel structure of the display device shown in Embodiment Modes 1 and 2.

Figure 15A:
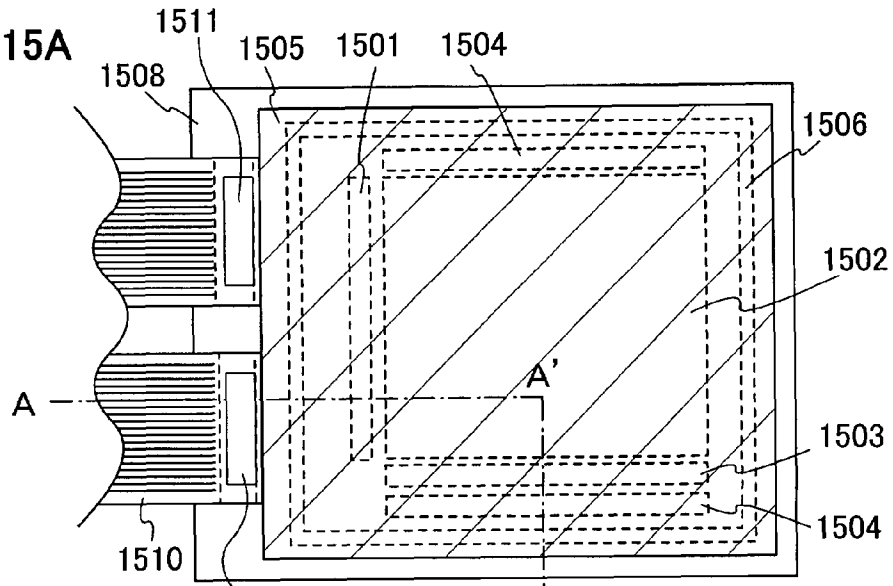
FIGS. 15A and 15B each illustrate a panel structure of an active matrix display device.
Figure 15B:
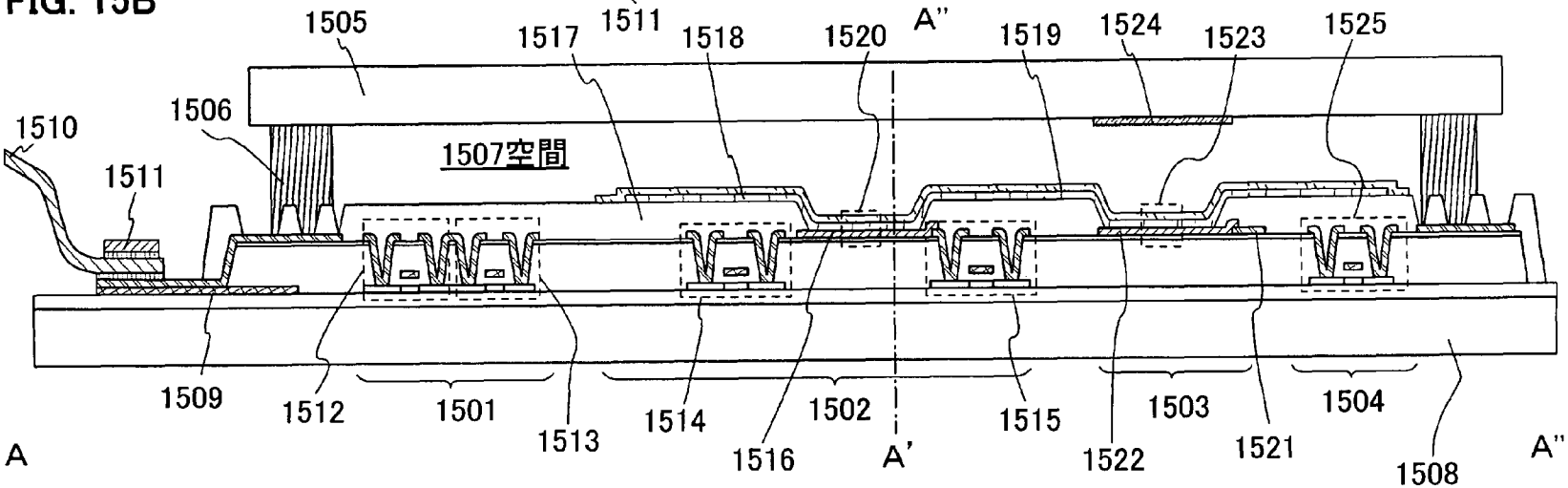

First, description is made on one example of the panel structure of the display device shown in Embodiment Mode 1. FIG. 15A is a top view of the display device while FIG. 15B is a cross-sectional view thereof along a line A-A'-A". As indicated by dotted lines, the display device includes a driver circuit portion (source signal line driver circuit) 1501, a pixel portion 1502, a monitoring element portion 1503 and a driver circuit portion (gate signal line driver circuit) 1504. The space surrounded by a sealing substrate 1505 and a sealant 1506 corresponds to a space 1507.

Note that a wiring 1509 is a wiring for transmitting signals inputted to the source signal line driver circuit 1501 or the gate signal line driver circuit 1504, and receiving video signals, clock signals, start signals, reset signals and the like from an FPC (Flexible Printed Circuit) 1510 as an external input terminal. On the FPC 1510, an IC chip (semiconductor integrated circuit) 1511 is connected by COG (Chip On Glass) bonding. Note that the IC chip 1511 may be connected by TAB (Tape Automated Bonding) or by use of a printed board as well.

Next, description is made with reference to FIG. 15B on the cross-sectional structure of FIG. 15A. Over a substrate 1508, the source signal line driver circuit 1501, the pixel portion 1502, the monitoring element portion 1503 and the gate signal line driver circuit 1504 are formed.

Note that the source signal line driver circuit 1501 is constituted by a CMOS circuit which has an n-channel TFT 1512 and a p-channel TFT 1513. A TFT 1525 is a TFT which constitutes the gate signal line driver circuit 1504. TFTs for forming the driver circuits may be formed by using a known CMOS circuit, PMOS circuit or NMOS circuit as well. In addition, although this embodiment mode shows a driver integrated structure in which driver circuits are formed over a substrate, the invention is not limited to this, and the driver circuits may be formed outside of the substrate as well.

In addition, the pixel portion 1502 includes a plurality of pixels each of which includes a switching TFT 1514, a current-controlling TFT 1515 and a first electrode 1516 electrically connected to a drain of the current-controlling TFT 1515. Note that an insulator 1517 is formed covering an edge of the first electrode 1516. Here, the insulator 1517 is formed of a positive photosensitive acrylic resin film.

In addition, in order to improve the coverage, a top or bottom end of the insulator 1517 is formed to have a curved surface with a curvature. For example, in the case of using positive photosensitive acrylic for the material of the insulator 1517, it is preferable that only a top end of the insulator 1517 have a curved surface with a curvature radius (0.2 to 3 μm). In addition, the insulator 1517 may be formed using either a negative photosensitive material which does not dissolve into etchant by light exposure or a positive photosensitive material which dissolves into etchant by light exposure.

Over the first electrode 1516, an electroluminescent layer 1518 and a second electrode 1519 are formed. Here, the first electrode 1516 functioning as an anode is desirably formed of a material having a high work function. For example, the first electrode 1516 may be formed using a single-layer film such as a titanium film, a chromium film, a tungsten film, a Zn film or a Pt film as well as a stacked-layer structure of a titanium nitride film and a film containing aluminum as a main component, a three-layer structure of a titanium nitride film, a film containing aluminum as a main component and a titanium nitride film, or the like. Note that when the first electrode 1516 is formed to have a stacked-layer structure, resistance as a wiring can be suppressed, an excellent ohmic contact can be obtained and further the first electrode can function as an anode.

The electroluminescent layer 1518 is formed by vapor deposition using an evaporation mask or ink-jet deposition. The electroluminescent layer 1518 is partially formed using a metal complex of the fourth group in the periodic table, with which either a low-molecular-weight or high-molecular-weight material may be combined. Generally, the electroluminescent layer is often formed using an organic compound in a single layer or stacked layers; however, in the invention, the film formed of an organic compound may partially contain an inorganic compound. Further, a known triplet light-emitting material may be used as well.

Further, as a material of the second electrode 1519 formed over the electroluminescent layer 1518, a material having a low work function (e.g., Al, Ag, Li or Ca, or alloys thereof such as MgAg, MgIn, AlLi, or compounds thereof $CaF_2$ and CaN) may be used. Note that the display panel herein has a top-emission structure; therefore, the second electrode 1519 is preferably formed to have stacked layers of an aluminum film with a thickness of 1 to 10 nm, an aluminum film containing a slight amount of Li or a thin metal film, and a light-transmissive conductive film (e.g., ITO (Indium Tin Oxide), IZO (Indium Zinc Oxide), ZnO (Zinc Oxide)).

A monitoring element 1523 is formed, which has a structure that the electroluminescent layer 1518 is interposed between a wiring 1521 which is formed of the same material as the first electrode 1516 electrically connected to a drain of the current-controlling TFT 1515 in the pixel portion 1502, an anode 1522 connected to the wiring 1521 and the second electrode 1519. Note that a light-shielding film 1524 is formed above the monitoring element portion 1503 so as to shield light emitted from the monitoring element 1523.

Further, by sticking the sealing substrate 1505 to the element substrate 1508 with the sealant 1506, such a structure is obtained that the space 1507 surrounded by the element substrate 1508, the sealing substrate 1505 and the sealant 1506 is provided with the electroluminescent element 1520 and the monitoring element 1523. Note that a structure where the space 1507 is filled with the sealant 1506 may be adopted except the structure where the space 1507 is filled with inert gas (e.g. nitrogen or argon).

Note that the sealant 1506 is preferably formed of an epoxy resin. In addition, it is desirable that such a material should not transmit moisture or oxygen. In addition, the sealing substrate 1505 can be formed by using a glass substrate or a quartz substrate as well as a plastic substrate formed of FRP (Fiberglass-Reinforced Plastics), PVF (polyinylfluoride), acrylic or the like.

In this manner, an active matrix display device can be obtained.

Note that FIGS. 15A and 15B illustrate a panel of a display device of a top-emission structure; however, it is needless to mention that the invention can be applied to a bottom-emission structure or a dual-emission structure.

Description is made below with reference to FIG. 17A on a light-emitting element of a dual-emission structure.

Over a substrate 1700, a current-controlling TFT 1701 is formed, and a first electrode 1702 is formed in contact with a drain electrode of the current-controlling TFT 1701, over which a layer 1703 containing an organic compound and a second electrode 1704 are formed.

The first electrode 1702 is an anode of a light-emitting element. In addition, the second electrode 1704 is a cathode of the light-emitting element. That is, the portion in which the layer 1703 containing an organic compound is interposed between the first electrode 1702 and the second electrode 1704 corresponds to the light-emitting element.

As the material of the first electrode 1702 functioning as an anode, a material having a high work function is desirably employed. For example, a light-transmissive conductive film such as an ITO (Indium Tin Oxide) film and an IZO (Indium Zinc Oxide) film can be employed. By using such a light-transmissive conductive film, an anode capable of transmitting light can be formed.

Meanwhile, as the material of the second electrode 1704 functioning as a cathode, it is preferable to employ stacked layers of a thin metal film formed of a material having a low work function (e.g., Al, Ag, Li or Ca or alloys thereof such as MgAg, MgIn, AlLi, $CaF_2$ or CaN) and a light-transmissive conductive film (e.g., ITO (Indium Tin Oxide), IZO (Indium Zinc Oxide) or ZnO (Zinc Oxide)). By using such a thin metal film and light-transmissive conductive film, a cathode capable of transmitting light can be formed.

Figure 17A:
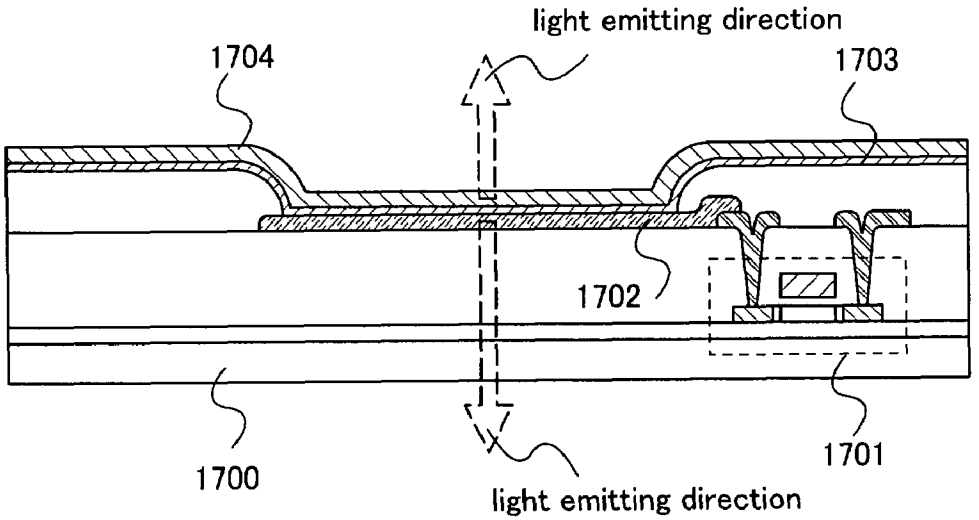
FIGS. 17A and 17B illustrate examples of a light-emitting element applicable to an active matrix display device.

In this manner, light from the light-emitting element can be extracted to both sides as shown by arrows in FIG. 17A. That is, when the structure shown in FIG. 17A is applied to the panel of the display device in FIGS. 15A and 15B, light can be emitted to the sides of the substrate 1508 and the sealing substrate 1505. Thus, in the case where a light-emitting element of a dual-emission structure is used in a display device, each of the substrate 1508 and the sealing substrate 1505 is formed of a light-transmissive substrate.

In addition, in the case of providing an optical film, each of the substrate 1508 and the sealing substrate 1505 may be provided with an optical film.

Description is made below with reference to FIG. 17B on a light-emitting element of a bottom-emission structure.

Over a substrate 1710, a current-controlling TFT 1711 is formed, and a first electrode 1712 is formed in contact with a drain electrode of the current-controlling TFT 1711, over which a layer 1713 containing an organic compound and a second electrode 1714 are formed.

The first electrode 1712 is an anode of a light-emitting element. In addition, the second electrode 1714 is a cathode of the light-emitting element. That is, the portion in which the layer 1713 containing an organic compound is interposed between the first electrode 1712 and the second electrode 1714 corresponds to the light-emitting element.

As the material of the first electrode 1712 functioning as an anode, a material having a high work function is desirably employed. For example, a light-transmissive conductive film such as an ITO (Indium Tin Oxide) film and an IZO (Indium Zinc Oxide) film can be employed. By using such a light-transmissive conductive film, an anode capable of transmitting light can be formed.

Meanwhile, as the material of the second electrode 1714 functioning as a cathode, a metal film can be employed, which is formed of a material having a low work function (e.g., Al, Ag, Li or Ca, alloys thereof such as MgAg, MgIn, AlLi, or compounds thereof such as $CaF_2$ or CaN). By using such a light-reflective metal film, a cathode which does not transmit light can be formed.

Figure 17B:
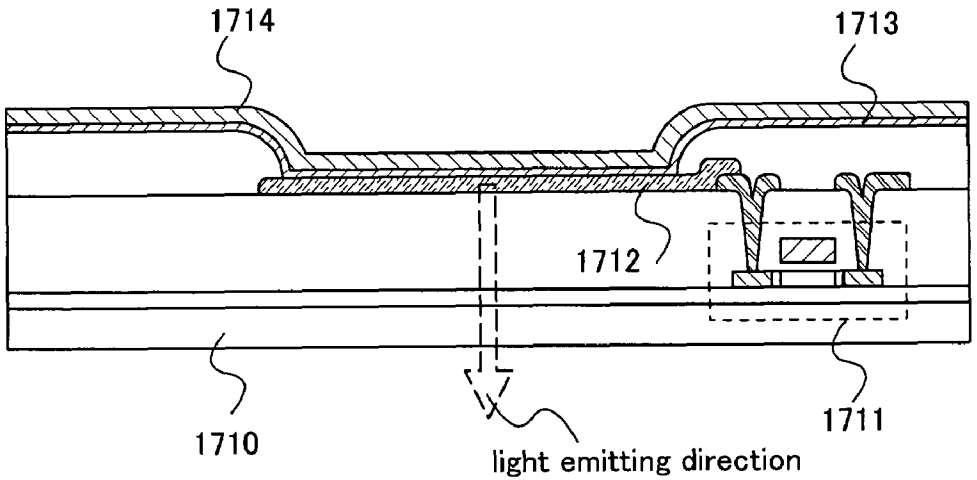

In this manner, light from the light-emitting element can be extracted to the bottom side as shown by an arrow in FIG. 17B. That is, when the structure of FIG. 17B is applied to the panel of the display device in FIGS. 15A and 15B, light can be emitted to the side of the substrate 1508. Thus, in the case where a light-emitting element of a bottom-emission structure is used in a display device, the substrate 1508 is formed of a light-transmissive substrate.

In addition, in the case of providing an optical film, the substrate 1508 may be provided with an optical film.

In addition, the invention can also be applied to a display device which realizes a full color display by using white-light-emitting elements and color filters.

Figure 18:
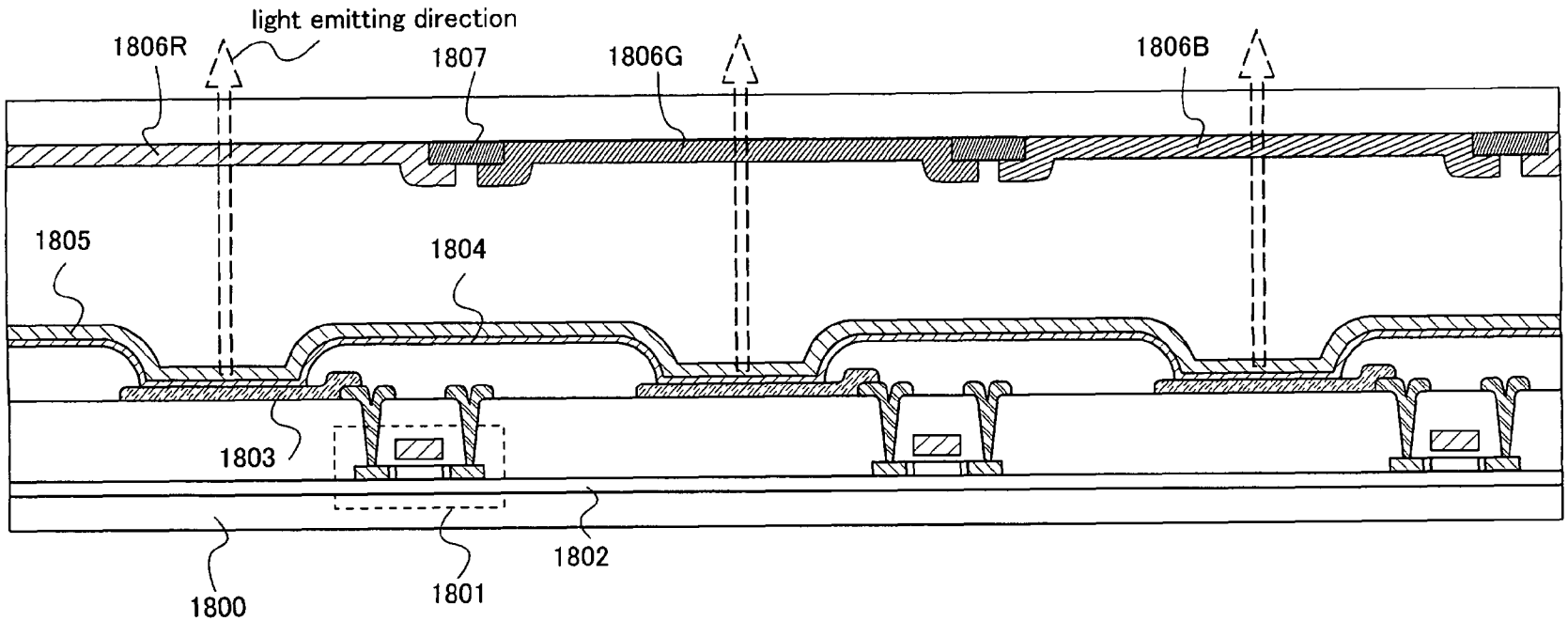
FIG. 18 illustrates an example of a light-emitting element applicable to an active matrix display device.

As shown in FIG. 18, a current-controlling TFT 1801 is formed over a substrate 1800 with a base film 1802 interposed therebetween, and a first electrode 1803 is formed in contact with a drain electrode of the current-controlling TFT 1801, over which a layer 1804 containing an organic compound and a second electrode 1805 are formed. Note that the base film 1802 is not necessarily provided.

The first electrode 1803 is an anode of a light-emitting element. In addition, the second electrode 1805 is a cathode of the light-emitting element. That is, the portion in which the layer 1804 containing an organic compound is interposed between the first electrode 1803 and the second electrode 1805 corresponds to the light-emitting element. In the structure of FIG. 18, white light is emitted. Above the light-emitting element, a red color filter 1806R, a green color filter 1806G and a blue color filter 1806B are provided, thereby a full color display can be performed. In addition, a black matrix (also referred to as a BM) 1807 for separating these color filters is provided.

The structure of FIG. 18 can be applied to the display device described in Embodiment Mode 1 in the case where a common potential is inputted to current source lines. Light-emitting elements in the pixel portion are only white-light-emitting elements. Therefore, by forming the monitoring elements with a material similar to that of the light emitting elements in the pixel portion, uniform element characteristics can be provided, which leads to higher accuracy of a compensation function.

Figure 16A:
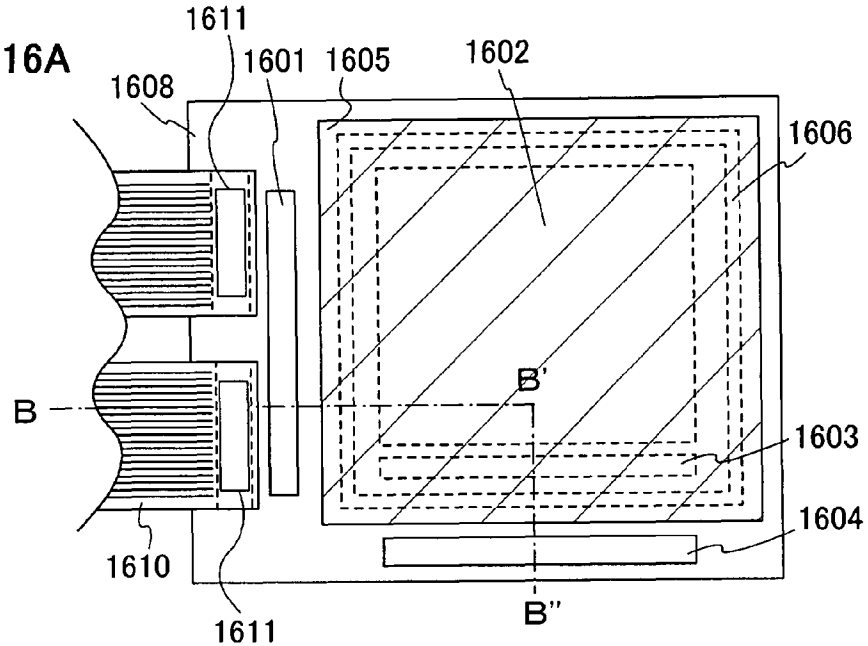
FIGS. 16A and 16B each illustrate a panel structure of a passive matrix display device.
Figure 16B:
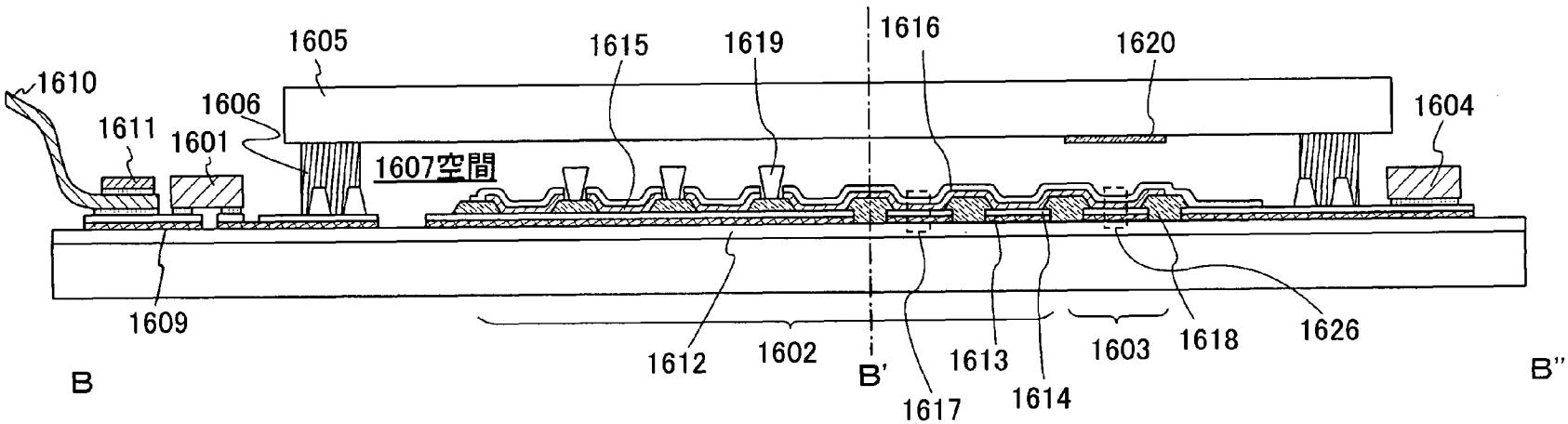

Next, description is made with reference to FIGS. 16A and 16B on an example of a panel structure of the display device shown in Embodiment Mode 2. Note that FIG. 16A is a top view of a display device, and FIG. 16B is a cross-sectional view thereof along a line B-B'-B". As indicated by the dotted lines, the display device includes a driver circuit portion (column signal line driver circuit) formed in an IC chip 1601, a pixel portion 1602, a monitoring element portion 1603 and a driver circuit portion (row signal line driver circuit) formed in an IC chip 1604. The space surrounded by a substrate 1608, a sealing substrate 1605 and a sealant 1606 corresponds to a space 1607.

Note that a wiring 1609 is a wiring for transmitting signals inputted to the column signal line driver circuit or the row signal line driver circuit, and receiving video signals, clock signals, start signals and the like from an FPC (Flexible Printed Circuit) 1610 as an external input terminal. An IC chip (semiconductor integrated circuit) 1611 is connected to the FPC by COG (Chip On Glass) bonding. Note that the IC chip may be connected by TAB (Tape Automated Bonding) or by use of a printed board as well.

Next, description is made with reference to FIG. 16B on the cross-sectional structure of FIG. 16A. Over a substrate 1608, the pixel portion 1602 and the monitoring element portion 1603 are formed. The column signal line driver circuit portion and the row signal line driver circuit portion are formed over IC chips 1601 and 1604, which are connected to the substrate 1608 by COG (Chip On Glass) bonding.

Over the substrate 1608, a base insulating film 1612 is formed, over which a stacked-layered column signal line is formed. A lower layer 1613 is a light-reflective metal film, and an upper layer 1614 is a light-transmissive conductive oxide film. The upper layer 1614 is preferably formed of a conductive film having a high work function, which includes a light-transmissive conductive material such as indium tin oxide (ITO) as well as ITO containing Si (ITSO) and indium zinc oxide (IZO) which is the mixture of indium oxide and 2 to 20% of zinc oxide (ZnO), or a compound film which combines such materials. Above all, ITSO remains in an amorphous state even when applied with baking, unlike ITO which would be crystallized. Thus, ITSO is superior in planarity to ITO, and does not easily cause a short circuit to the cathode even when the layer containing an organic compound is thin, which is thus suitable for the anode of the light-emitting element.

The lower layer 1613 is formed of Ag, Al or an Al(C +Ni) alloy film. Above all, the Al(C +Ni) film (an aluminum alloy film containing carbon and nickel (1 to 20 wt %) is preferable as it does not cause a big fluctuation in the contact resistance value between the Al(C +Ni) film and ITO or ITSO even after electrically conducted or applied with thermal treatment.

A partition wall 1618 for insulating adjacent column signal lines is a black resin, which functions as a black matrix (BM) overlapping a boundary between different colored layers (provided on the side of the sealing substrate) or overlapping a gap. The area surrounded by the black partition wall has the same area as the light-emitting region correspondingly.

The layer 1615 containing an organic compound has stacked layers of an HIL (Hole-Injection Layer), HTL (Hole-Transporting Layer), an EML (light-emitting Layer), an ETL (Electron-Transporting Layer) and an EIL (Electron-Injection Layer) in this order from the side of a column signal line (anode). Note that the layer 1615 containing an organic compound may have a single-layer structure or a mixed structure as well as the stacked-layer structure.

A row signal line (cathode) 1616 is formed so as to cross the column signal line (anode). The row signal line (cathode) 1616 is formed of a light-transmissive conductive film such as ITO, ITO containing Si elements (ITSO), and IZO which is the mixture of indium oxide and 2 to 20% of zinc oxide (ZnO). The structure of this embodiment mode is an example of a display device of a top-emission structure in which the light travels through the sealing substrate 1605; therefore, it is vital that the row signal line 1616 transmit light. Note that a partition wall 1619 for insulating adjacent row signal lines is formed by photolithography using a positive photosensitive resin (with which an unexposed portion remains as a pattern) in such a manner that the lower portion of a pattern is etched to a larger degree by controlling the amount of exposed light and the developing time.

In this manner, the light-emitting element 1617 is formed.

In order to protect the light-emitting element 1617 from damage due to the moisture or degasification, a light-transmissive protective film for covering the row signal line 1616 may be provided. The light-transmissive protective film is preferably formed of a dense inorganic insulating film (e.g., SiN film or SiNO film) obtained by PCVD, a dense inorganic insulating film (e.g., SiN film or SiNO film) obtained by sputtering, a thin film containing carbon as a main component (e.g., DLC film, CN film or amorphous carbon film), a metal oxide film (e.g., $W0_2$, $CaF_2$ or $Al_2O_3$) or the like. Note that "light-transmissive" means that the transmissivity of visible light is 80 to 100%.

Above the monitoring element portion 1603 in which the monitoring element 1626 is formed, a light-shielding film 1620 is formed so that the light emitted from the monitoring element portion 1603 does not leak outside.

In addition, the pixel portion 1602 including light-emitting elements is sealed with the sealant 1606 and the sealing substrate 1605, and the space 1607 surrounded by them is sealed hermetically.

The sealant 1606 can be formed of an ultraviolet curable resin, a heat curable resin, a silicone resin, an epoxy rein, an acrylic resin, a polyimide resin, a phenol resin, PVC (polyvinyl chloride), PVB (polyvinyl butyral), EVA (ethylene vinyl acetate) or the like. In addition, the sealant 1606 may be added with filler (bar-like spacer or fiber-like spacer) or a spherical spacer.

In addition, the sealing substrate 1605 is formed of a glass substrate or a plastic substrate. As the plastic substrate, any of polyimide, polyamide, an acrylic resin, an epoxy resin, PES (polyether sulfone), PC (polycarbonate), PET (polyethylene terephthalate) and PEN (polyethylenenaphthalate) may be used in the form of a plate or a film.

On the other hand, an edge of the substrate 1608 is formed with a terminal electrode, to which the FPC (Flexible Printed Circuit) 1610 for connection with an external circuit is stuck. The terminal electrode is formed to have stacked layers of a lower layer 1613 as a light-reflective metal film and an upper layer 1614 as a light-transmissive conductive film; however, the invention is not specifically limited to this.

On the periphery of the pixel portion, the IC chips 1601 and 1604 each of which includes a driver circuit for transmitting each signal to the pixel portion, and the IC chip 1611 including an extrapolation power supply circuit are electrically connected to the display panel with an anisotropic conductive material 1621. In addition, in order to form a pixel portion corresponding to color display, 3072 column signal lines and 768 row signal lines are required for an XGA-class display panel. Such number of column signal lines and row signal lines are segmented per several blocks at the edge of the pixel portion so as to form lead lines, which are gathered in accordance with the pitch of the output terminals of the ICs.

The aforementioned display device is a display device of a top-emission structure, and the contrast thereof is improved by the black partition walls 1618 and 1619.

FIGS. 16A and 16B illustrate a panel of a display device of a top-emission structure; however, it is needless to mention that the invention can be applied to a bottom-emission structure or a dual-emission structure.

Description is made below with reference to FIG. 19A on a light-emitting element of a dual-emission structure.

The light-emitting element of a dual-emission structure includes a column signal line (anode) 1902 formed of a light-transmissive conductive oxide film, a layer 1904 containing an organic compound and a row signal line 1905 formed of a light-transmissive conductive oxide film. In addition, a partition wall 1903 is formed of a light-shielding material.

Figure 19A:
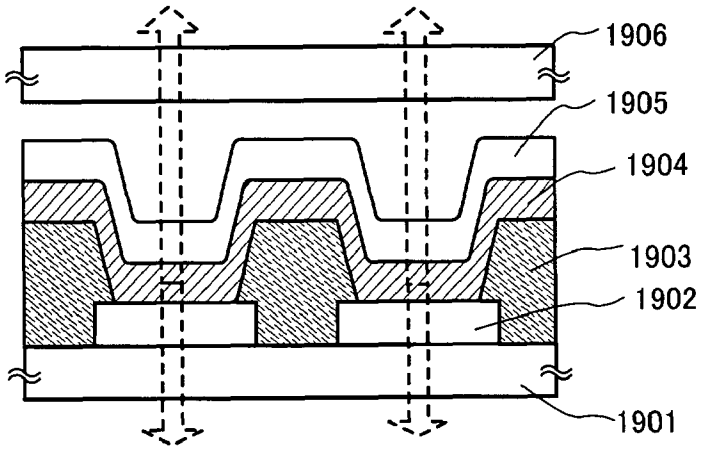
FIGS. 19A and 19B illustrate examples of light-emitting elements applicable to a passive matrix display device.

Light emitted from the light-emitting element is emitted in the directions of arrows in FIG. 19A, namely in both directions of a first substrate 1901 and a second substrate 1906. Thus, each of the first substrate 1901 and the second substrate 1906 is formed of a light-transmissive substrate.

In the case of providing an optical film, each of the first substrate 1901 and the second substrate 1906 may be provided with an optical film.

Figure 19B:
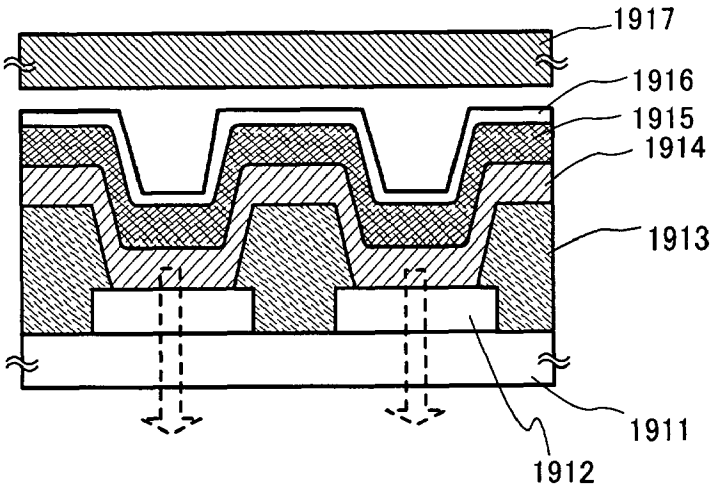

Description is made with reference to FIG. 19B on a light-emitting element of a bottom-emission structure.

The light-emitting element of a bottom-emission structure includes a column signal line (anode) 1912 formed of a light-transmissive conductive oxide film, a layer 1914 containing an organic compound and a row signal line 1915 formed of a light-reflective conductive film. In addition, a partition wall 1913 is formed of a light-shielding material.

Light emitted from the light-emitting element is emitted in the direction of arrows in FIG. 19B, namely in the direction to a first substrate 1911. Thus, the second substrate 1917 is not specifically required to transmit light, and it may be a metal plate. In addition, the provision of a thick protective film 1916 for improving the reliability of the light-emitting element is preferable since it does not decrease the light-extraction efficiency.

In the case of providing an optical film, the first substrate 1911 may be provided with an optical film.

Description is made below with reference to FIG. 20 on an example where a partition wall does not have an inverse-tapered shape, but have a forward-tapered shape. Note that the structure shown in FIG. 20 illustrates an example in which a full color display is realized by using white-light-emitting elements and color filters.

Over a first substrate 2001, a striped first electrode 2002 is formed. In this structure, a partition wall 2003 having an opening is formed over the first electrode 2002, over which a partition wall constituted by a first spacer 2006 and a second spacer 2007 with a large width over the first spacer 2006 is formed.

The first spacer 2006 is formed of an organic resin film such as polyimide and the second spacer 2007 is formed of a photosensitive resin film such as a resist. For example, an organic resin film such as polyimide is deposited first, on which a photosensitive resin film such as a resist is deposited. Then, a pattern of the photosensitive resin film such as a resist is left between the electrodes to be isolated, and the exposed organic resin film is etched. For this etching, the etching conditions are controlled so that the pattern of the photosensitive resin film is undercut. Through the aforementioned steps, an element-isolated structure, namely a partition wall can be formed.

Figure 20:
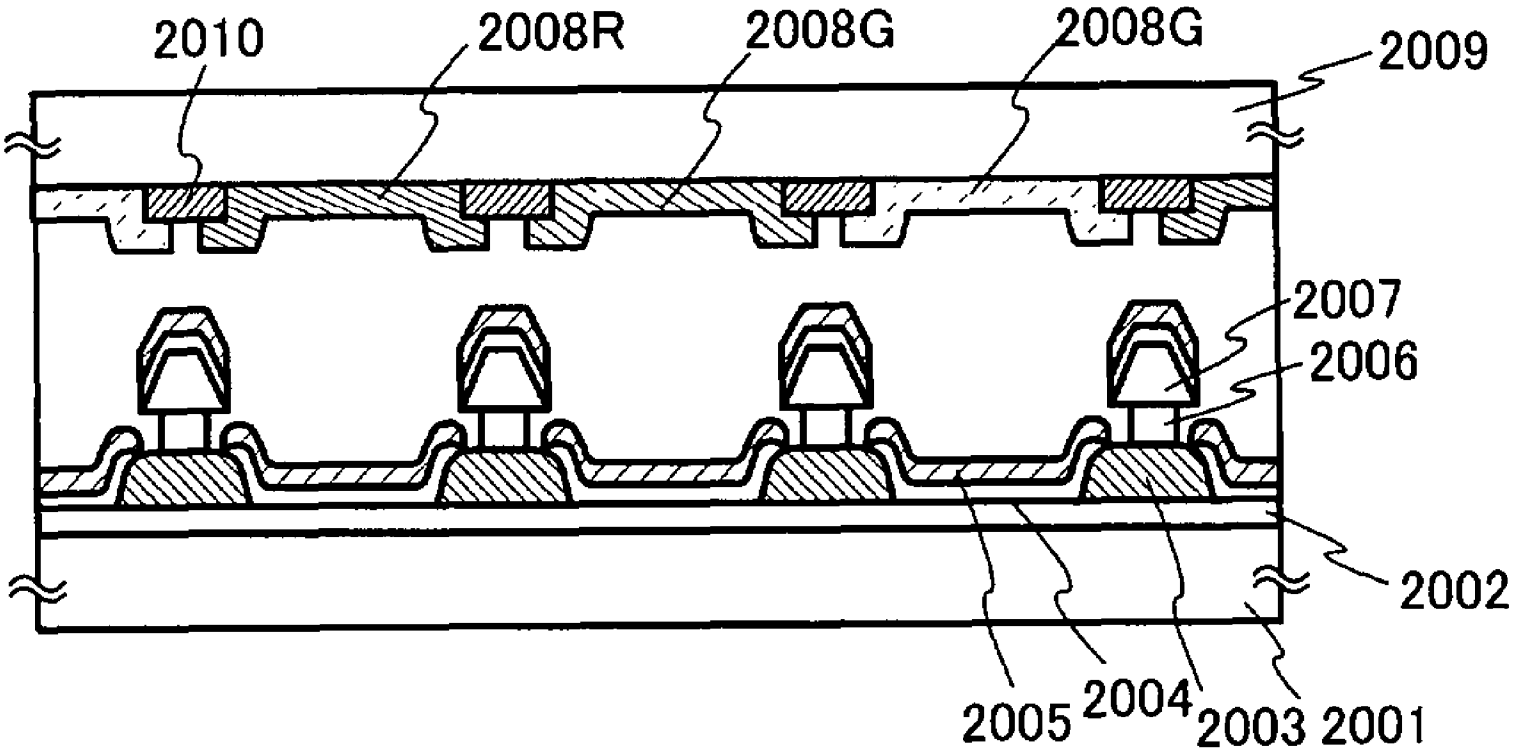
FIG. 20 illustrates an example of light-emitting elements applicable to a passive matrix display device.

In FIG. 20, each of the partition wall 2003 having an opening, the first spacer 2006 and the second spacer 2007 is formed using a light-shielding material to improve the contrast.

After forming the partition wall, a layer containing an organic compound and a light-transmissive conductive film are formed, thereby an isolated layer 2004 containing an organic compound and an isolated second electrode 2005 can be formed.

In addition, in FIG. 20, the layer 2004 containing an organic compound is formed to have stacked layers of a green-light-emitting layer (formed of $Alq_3$ doped with Coumarin 6) and a yellow-light-emitting layer (formed of TPD doped with rubrene) so as to constitute a white-light-emitting element which utilizes emission from two layers. In this structure, a selective coating step for each emission color can be omitted; therefore, the time for manufacturing the passive matrix light-emitting device can be reduced.

In addition, in order to perform a full color display, color filters constituted by only colored layers 2008R, 2008G and 2008B are provided on the second substrate 2009 in the opposed position to the pixels having white-light-emitting elements. In addition, a black matrix (also referred to as a BM) 2010 is provided to separate these color filters.

In addition, the structure of FIG. 20 can be applied to the display device described in Embodiment Mode 2 in the case where a common potential is inputted to each column signal line. The light-emitting elements in the pixel portion are only white-light-emitting elements. Therefore, when the monitoring element is formed of a similar material, uniform element characteristics can be obtained, which leads to the higher accuracy of a compensation function.

Embodiment Mode 3

The invention can be applied to various electronic appliances. Specifically, the invention can be applied to display portions of electronic appliances. Such electronic appliances include a video camera, a digital camera, a goggle display (head mounted display), a car navigation system, a sound reproducing device (e.g., car audio set or component stereo set), a computer, a game machine, a portable information terminal (e.g., mobile computer, portable phone, portable game machine or electronic book), an image reproducing device provided with a recording medium (specifically, a device for reproducing a recording medium such as a Digital Versatile Disk (DVD) and having a display portion for displaying the reproduced image) and the like.

Figure 21A:
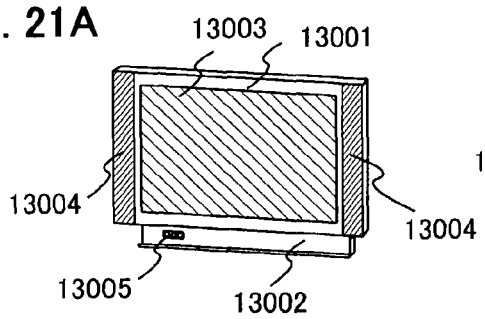
FIGS. 21A to 21H illustrate electronic appliances to which the display device of the invention can be applied.

FIG. 21A is a display which includes a housing 13001, a supporting base 13002, a display portion 13003, a speaker portion 13004, a video input terminal 13005 and the like. The display having the display portion 13003 to which the invention is applied can suppress the luminance change due to the ambient temperature change, thereby apparent luminance decay can be decreased. Note that the display includes all display devices for information display such as those for personal computers, TV broadcast reception, advertising displays and the like.

Figure 21B:
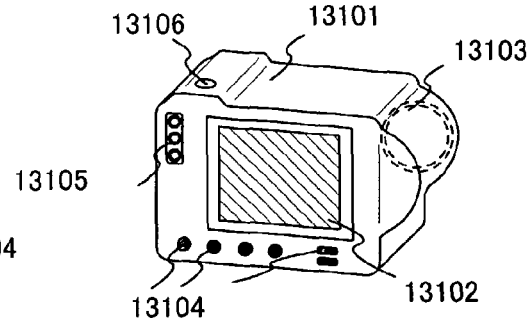

FIG. 21B is a camera which includes a main body 13101, a display portion 13102, an image receiving portion 13103, operating keys 13104, an external connection port 13105, a shutter 13106 and the like. The camera having the display portion 13102 to which the invention is applied can suppress the luminance change due to the ambient temperature change, thereby apparent luminance decay can be decreased.

Figure 21C:
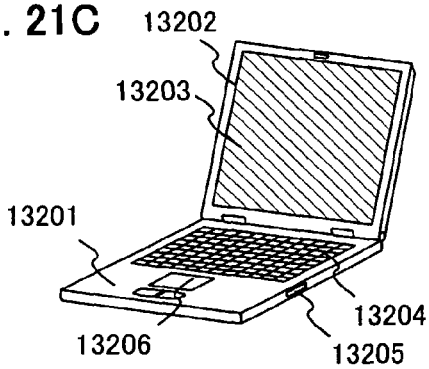

FIG. 21C is a computer which includes a main body 13201, a housing 13202, a display portion 13203, a keyboard 13204, an external connection port 13205, a pointing mouse 13206 and the like. The computer having the display portion 13203 to which the invention is applied can suppress the luminance change due to the ambient temperature change, thereby apparent luminance decay can be decreased.

Figure 21D:
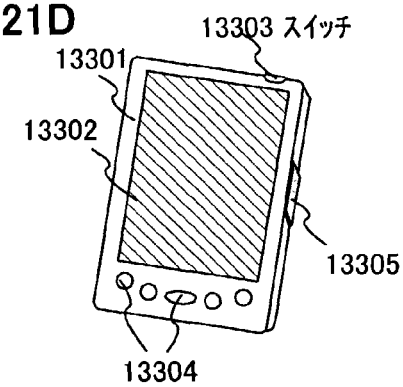

FIG. 21D is a mobile computer which includes a main body 13301, a display portion 13302, a switch 13303, operating keys 13304, an IR port 13305 and the like. The mobile computer having the display portion 13302 to which the invention is applied can suppress the luminance change due to the ambient temperature change, thereby apparent luminance decay can be decreased.

Figure 21E:
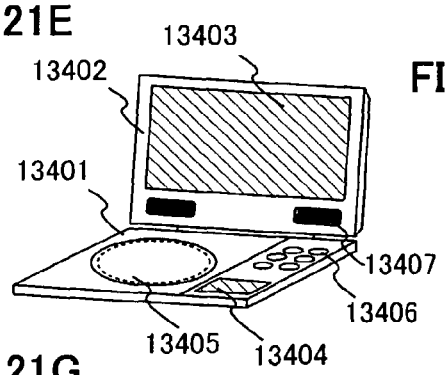

FIG. 21E is a portable image reproducing device (specifically, a DVD reproducing device) provided with a recording medium, which includes a main body 13401, a housing 13402, a display portion A 13403, a display portion B 13404, a recording medium (DVD) reading portion 13405, an operating key 13406, a speaker portion 13407 and the like. The display portion A 13403 mainly displays image data while the display portion B 13404 mainly displays text data. The image reproducing device having the display portions A 13403 and B 13404 to which the invention is applied can suppress the luminance change due to the ambient temperature change, thereby apparent luminance decay can be decreased.

Figure 21F:
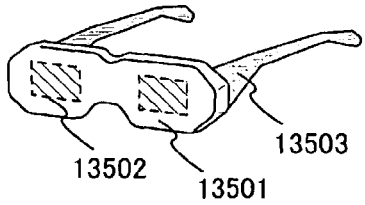

FIG. 21F is a goggle display (head mounted display) which includes a main body 13501, a display portion 13502, an arm portion 13503 and the like. The goggle display having the display portion 13502 to which the invention is applied can suppress the luminance change due to the ambient temperature change, thereby apparent luminance decay can be decreased.

Figure 21G:
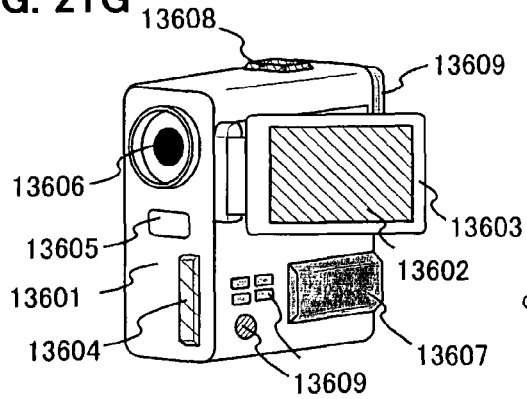

FIG. 21G is a video camera which includes a main body 13601, a display portion 13602, a housing 13603, an external connection port 13604, a remote controller receiving portion 13605, an image receiving portion 13606, a battery 13607, an audio input portion 13608, operating keys 13609, an eyepiece portion 13610 and the like. The video camera having the display portion 13602 to which the invention is applied can suppress the luminance change due to the ambient temperature change, thereby apparent luminance decay can be decreased.

Figure 21H:
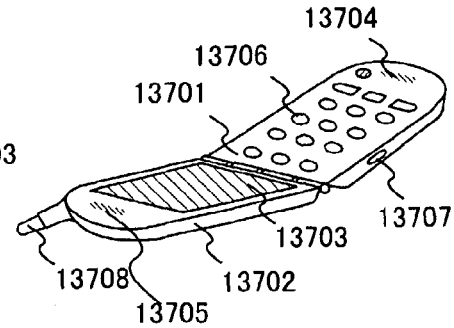

FIG. 21H is a portable phone which includes a main body 13701, a housing 13702, a display portion 13703, an audio input portion 13704, an audio output portion 13705, an operating key 13706, an external connection port 13707, an antenna 13708 and the like. The portable phone having the display portion 13703 to which the invention is applied can suppress the luminance change due to the ambient temperature change, thereby apparent luminance decay can be decreased.

As set forth above, the invention can be applied to various electronic appliances.

EXPLANATION OF REFERENCE

101: current source, 102: monitoring element, 103: anode, 104: amplifier, 105: an extrapolation power supply circuit, 106: switch, 107: A/D converter circuit, 108: voltage-mathematization circuit, 109: D/A converter circuit, 110: amplifier, 111: temperature-characteristic-detection monitoring circuit, 112: memory circuit, 113: counter circuit, 114: driving transistor, 115: light-emitting element, 201*a*: line, 201*b*: line 201*c*: line, 202*a*: line, 202*b*: line, 202*c*: line, 301: amplifier, 401: source signal line driver circuit, 402: gate signal line driver circuit, 403: pixel portion, 404: monitoring element group, 405: current source, 406: extrapolation power supply circuit, 407: amplifier, 408: switch, 409: anode, 410: pulse output circuit, 411: first latch circuit, 412: second latch circuit, 413: pixel, 501: switch, 502: analog switch, 503: analog switch, 504: inverter, 505: counter circuit, 506: determination circuit, 507: determination reference value memory, 601: amplifier, 701: switch, 702: switch, 703: capacitor, 704: switch, 705: inverter, 706: inverter, 801: source signal line driver circuit, 802: gate signal line driver circuit, 803: pixel portion, 804*r*1 to 804*rm*: monitoring elements, 804*g*1 to 804*gm*: monitoring elements, 804*b*1 to 804*bm*: monitoring elements, 805*r*: curret source, 805*g*: current source, 805*b*: current source 806*r*: extrapolation power supply circuit, 806*g*: extrapolation power supply circuit, 806*b*: extrapolation power supply circuit, 807*r*: voltage follower circuit, 807*g*: voltage follower circuit, 807*b*: voltage follower circuit, 808*r*: switch, 808*g*: switch, 808*b*: switch, 809: pixel, 901: current source, 902: monitoring element, 903: anode, 904: amplifier, 905: extrapolation power supply circuit, 906: switch, 907: A/D converter circuit, 908: voltage-mathematization circuit, 909: D/A converter circuit, 910: temperature-characteristic-detection monitoring circuit, 911: memory circuit, 912: counter circuit, 913: column signal line driver circuit, 914: pulse output circuit, 915: first latch circuit, 916: second latch circuit, 917*a*1: switch, 917*a*2: switch, 1001: column signal line, 1005: extrapolation power supply circuit, 1006: voltage follower circuit, 1007: monitoring element, 1008: switch, 1009: light-emitting element, 1010: anode, 1101: line, 1102: line, 1103: line, 1201: line, 1202: line, 1301: column signal line driver circuit, 1302: row signal line driver circuit, 1303: pixel portion, 1304*r*: current source, 1304*g*: current source, 1304*b*: current source, 1305*r*: extrapolation power supply circuit, 1305*g*: extrapolation power supply circuit, 1305*b*: extrapolation power supply circuit, 1306*r*: switch, 1306*g*: switch 1306*b*: switch, 1307*r*: voltage follower circuit, 1307*g*: voltage follower circuit, 1307*b*: voltage follower circuit, 1308*r*: monitoring element group, 1308*g*: monitoring element group, 1308*b*: monitoring element group, 1309*r*: pixel, 1309*g*: pixel, 1309*b*: pixel, 1310: pulse output circuit, 1311:

first latch circuit, 1312: second latch circuit, 1313: switch, 1401: switching transistor, 1402: capacitor, 1403: driving transistor, 1404: light-emitting element, 1405: gate signal line, 1406: source signal line, 1407: power supply line, 1408: erasing transistor, 1409: erasing signal line, 1501: source signal line driver circuit, 1502: pixel portion, 1503: monitoring element portion, 1504: gate signal line driver circuit, 1505: sealing substrate, 1506: sealant, 1507: space, 1508: substrate, 1509: wiring, 1510: FPC, 1511: IC chip, 1512: n-channel TFT, 1513: p-channel TFT, 1514: switching TFT, 1515: current-controlling TFT, 1516: first electrode, 1517: insulator, 1518: electroluminescent layer, 1519: second electrode, 1520 electroluminescent element, 1521: wiring, 1522: anode, 1523: monitoring element, 1524: light-shielding film, 1525: TFT, 1601: IC chip, 1602: pixel portion, 1603 monitoring element portion, 1604: IC chip, 1605: sealing substrate, 1606: sealant, 1607: space, 1608: substrate, 1609: wiring, 1610: FPC, 1611: IC chip, 1612: base insulating film, 1613: lower layer, 1614: upper layer, 1615: layer containing an organic compound, 1616: row signal line, 1617: light-emitting element, 1618: partition wall, 1619: partition wall, 1620: light-shielding film, 1621: monitoring element, 1700: substrate, 1701: current-controlling TFT, 1702: first electrode, 1703: layer containing an organic compound, 1704: second electrode, 1710: substrate, 1711: current-controlling TFT, 1712: first electrode, 1713: layer containing an organic compound, 1714: second electrode, 1800: substrate, 1801: current-controllling TFT, 1802: base film, 1803: first electrode, 1804: layer containing an organic compound, 1805: second electrode, 1806R: color filter, 1806G: color filter, 1806B: color filter, 1807: black matrix, 1901: first substrate, 1902: column signal line, 1903: partition wall, 1904: layer containing an organic compound 1905: row signal line, 1906: second substrate, 1911: first substrate, 1912: column signal line, 1913: partition wall, 1914: layer containing an organic compound, 1915: row signal line, 1916: protective film, 1917: second substrate, 2001: first substrate, 2002: first electrode, 2003: partition wall, 2004: layer containing an organic compound, 2005: second electrode, 2006: first spacer, 2007: second spacer, 2008R: colored layer, 2008G: colored layer, 2008B: colored layer, 2009 second substrate, 13001: housing, 13002: supporting base, 13003: display portion, 13004: speaker portion, 13005: video input, terminal, 13101: main body, 13102: display portion, 13103: image receiving portion, 13104: operating key, 13105: external connection port, 13106: shutter, 13201: main body, 13202: housing, 13203: display portion, 13204: keyboard, 13205: external connection port, 13301: main body, 13302: display portion, 13303: switch, 13304: operating key, 13305: IR port, 13401: main body, 13402: housing, 13403: display portion A, 13404: display portion B, 13405: recording medium reading portion, 13406: operating key, 13407: speaker portion, 13501: main body, 13502: display portion, 13503: arm portion, 13601: main body, 13602: display portion, 13603: housing, 13604: external connection port, 13605: remote controller receiving portion, 13606: image receiving portion, 13607: battery, 13608: audio input portion, 13609: operating key, 13610: eyepiece portion, 13701: main body, 13702: housing, 13703: display portion, 13704: audio input portion, 13705: audio output portion, 13706: operating key, 13707: external connection port, 13708: antenna.

The invention claimed is:

1. A display device comprising:

a monitoring element;

a current source for supplying a current to the monitoring element;

an amplifier for outputting the same or substantially the same voltage as a voltage generated in the monitoring element;

an extrapolation power supply circuit for sampling voltages generated in the monitoring element, obtaining a mathematical formula of a change of the sampled voltages and generating a voltage based on the mathematical formula;

a light-emitting element; and a switch configured to select, in a first switch connection, an output of the amplifier and, in a second switch connection, an output of the extrapolation power supply circuit as a voltage source for supplying a voltage to the light-emitting element, wherein the amplifier is electrically connectable to the light-emitting element through at least the switch, and wherein the extrapolation power supply circuit is electrically connectable to the light-emitting element through at least the switch.

2. A display device comprising:

a monitoring element;

a current source for supplying a current to the monitoring element;

an extrapolation power supply circuit for sampling voltages generated in the monitoring element, obtaining a mathematical formula of a change of the sampled voltages and generating a voltage based on the mathematical formula;

a light-emitting element;

an amplifier for outputting the same or substantially the same voltage as the voltages generated in the monitoring element or the voltage generated by the extrapolation power supply circuit; and a switch configured to select, in a first switch connection, the voltage generated in the monitoring element and, in a second switch connection, the voltage generated by the extrapolation power supply circuit as a voltage inputted to the amplifier, wherein the monitoring element is electrically connectable to an input terminal of the amplifier through at least the switch, wherein the extrapolation power supply circuit is electrically connectable to the input terminal of the amplifier through at least the switch, and wherein an output terminal of the amplifier is electrically connectable to the light-emitting element.

3. The display device according to claim 1 or 2, wherein the monitoring element is provided in plural number and connected in parallel.

4. The display device according to claim 1 or 2, wherein the monitoring element is provided correspondingly to each emission color of the light-emitting element, and light emitting layers of the monitoring element and the light-emitting element are formed of the same material.

5. The display device according to claim 1 or 2, wherein the amplifier is a voltage follower circuit.

6. The display device according to claim 1 or 2, wherein the selection of the switch is switched after a preset emission period of the display device has passed.

7. An electronic appliance comprising as a display portion the display device according to claim 1 or 2.

8. An active matrix display device comprising:

a monitoring element;

a current source for supplying a current to the monitoring element;

an amplifier for outputting the same or substantially the same potential as a potential of an anode of the monitoring element;

an extrapolation power supply circuit for sampling potentials of the anode of the monitoring element, obtaining a mathematical formula of a change of the sampled potentials and generating a potential based on the mathematical formula;

a light-emitting element;

a transistor for controlling the light-emitting element; and a switch configured to select, in a first switch connection, an output of the amplifier and, in a second switch connection, an output of the extrapolation power supply circuit as a voltage source for supplying a voltage to the light-emitting element, wherein the amplifier is electrically connectable to one of a source terminal and a drain terminal of the transistor through at least the switch, wherein the extrapolation power supply circuit is electrically connectable to the one of the source terminal and the drain terminal of the transistor through at least the switch, and wherein the other one of the source terminal and the drain terminal of the transistor is electrically connectable to the light-emitting element.

9. An active matrix display device comprising:

a monitoring element;

a current source for supplying a current to the monitoring element;

an extrapolation power supply circuit for sampling potentials of an anode of the monitoring element, obtaining a mathematical formula of a change of the sampled potentials and generating a potential based on the mathematical formula;

an amplifier for outputting the same or substantially the same voltage as an inputted voltage;

a switch configured to select, in a first switch connection, the voltage generated in the monitoring element and, in a second switch connection, the voltage generated by the extrapolation power supply circuit as a voltage inputted to the amplifier;

a light-emitting element; and a transistor for controlling the light-emitting element, wherein the monitoring element is electrically connectable to an input terminal of the amplifier through at least the switch, wherein the extrapolation power supply circuit is electrically connectable to the input terminal of the amplifier through at least the switch, and wherein an output terminal of the amplifier is electrically connectable to the light-emitting element through at least the transistor.

10. The active matrix display device according to claim 8 or 9, wherein the monitoring element is provided in plural number and connected in parallel.

11. The active matrix display device according to claim 8 or 9, wherein a cathode of the monitoring element and a cathode of the light-emitting element are connected.

12. A driving method of a display device which includes a monitoring element, a current source, an extrapolation power supply circuit, an amplifier and a light-emitting element, comprising the steps of:

supplying a current to the monitoring element from the current source;

sampling voltages of the monitoring element, obtaining a mathematical formula of a change of the sampled voltages and generating a voltage based on the mathematical formula by the extrapolation power supply circuit;

impedance-converting the voltage generated in an anode of the monitoring element by the amplifier;

applying a voltage outputted from the amplifier to the light-emitting element;

switching a voltage supply source of the light-emitting element by applying a voltage outputted from the extrapolation power supply circuit to the light-emitting element.

13. A driving method of a display device according to claim 12, wherein the voltage outputted from the amplifier is applied to the light-emitting element until a preset condition is satisfied, and wherein the voltage outputted from the extrapolation power supply circuit is applied to the light-emitting element when the preset condition is satisfied.

14. A driving method of a display device which includes a monitoring element, a current source, an extrapolation power supply circuit, an amplifier and a light-emitting element, comprising the steps of:

supplying a current to the monitoring element from the current source;

sampling voltages of the monitoring element, obtaining a mathematical formula of a change of the sampled voltages and generating a voltage based on the mathematical formula by the extrapolation power supply circuit;

impedance-converting one of the voltages generated in the monitoring element and the voltage generated in the extrapolation power supply circuit by the amplifier;

connecting an input terminal of the amplifier to an anode of the monitoring element until a preset condition is satisfied;

switching a voltage supply source of the light-emitting element by connecting the input terminal of the amplifier to an output terminal of the extrapolation power supply circuit when the preset condition is satisfied.

* * * * *